US011684162B2

(12) United States Patent
Sramek

(10) Patent No.: US 11,684,162 B2
(45) Date of Patent: Jun. 27, 2023

(54) EASY CHAIR WITH EXERCISE AND HEALTH BENEFITS

(71) Applicant: Roger Anton Sramek, Mill Valley, CA (US)

(72) Inventor: Roger Anton Sramek, Mill Valley, CA (US)

( * ) Notice: Subject to any disclaimer, the term of this patent is extended or adjusted under 35 U.S.C. 154(b) by 61 days.

(21) Appl. No.: 16/531,066

(22) Filed: Aug. 4, 2019

(65) Prior Publication Data

US 2020/0046128 A1 Feb. 13, 2020

Related U.S. Application Data

(60) Provisional application No. 62/717,800, filed on Aug. 11, 2018.

(51) Int. Cl.

| | |
|---|---|
| ***A47C 7/62*** | (2006.01) |
| ***A47C 7/68*** | (2006.01) |
| ***A47C 7/24*** | (2006.01) |
| ***A47C 1/02*** | (2006.01) |
| ***A47C 27/08*** | (2006.01) |
| ***A63B 21/16*** | (2006.01) |
| ***A63B 21/04*** | (2006.01) |
| ***A63B 21/055*** | (2006.01) |
| ***A61G 5/14*** | (2006.01) |

(52) U.S. Cl.

CPC ..... *A47C 7/62* (2013.01); *A47C 1/02* (2013.01); *A47C 7/24* (2013.01); *A47C 7/624* (2018.08); *A47C 7/68* (2013.01); *A47C 27/082* (2013.01); *A47C 27/083* (2013.01); *A61G 5/14* (2013.01); *A63B 21/0442* (2013.01); *A63B 21/0552* (2013.01); *A63B 21/1609* (2015.10); *A63B 2208/0233* (2013.01); *A63B 2225/682* (2013.01); *A63B 2225/685* (2013.01); *A63B 2225/687* (2013.01)

(58) Field of Classification Search

None

See application file for complete search history.

(56) References Cited

U.S. PATENT DOCUMENTS

| | | | | | |
|---|---|---|---|---|---|
| 4,921,247 | A * | 5/1990 | Sterling | A63B 17/00 | 482/130 |
| 5,080,353 | A * | 1/1992 | Tench | A63B 21/154 | 482/130 |
| 5,234,394 | A * | 8/1993 | Wilkinson | A63B 21/055 | 482/121 |
| 5,387,171 | A * | 2/1995 | Casey | A63B 21/0552 | 482/130 |
| 5,749,668 | A * | 5/1998 | McIlvain | A63B 21/154 | 482/79 |
| 5,755,650 | A * | 5/1998 | Urso | A47C 9/002 | 248/118 |
| D420,071 | S * | 2/2000 | Tench | D21/690 | |

(Continued)

*Primary Examiner* — David E Allred

(74) *Attorney, Agent, or Firm* — Thomas M. Freiburger

(57) ABSTRACT

A seating apparatus cushioned for providing comfortable seating of a body for living room, office and other seating environments. The seating apparatus includes a frame for a seat, a back component, arms and legs and includes one or more supports fixed with respect to the frame and extending from the seating apparatus to provide stationary anchors for use by the body in exercising and for ingress and egress from the seating apparatus.

8 Claims, 17 Drawing Sheets

(56) References Cited

U.S. PATENT DOCUMENTS

| | | | | |
|---|---|---|---|---|
| 11,007,400 | B1 * | 5/2021 | Stoddard | A63B 21/151 |
| 11,052,005 | B2 * | 7/2021 | Childs | A61G 7/053 |
| 2006/0258517 | A1 * | 11/2006 | Ashley | A63B 21/154 482/904 |
| 2010/0204027 | A1 * | 8/2010 | Dauterive | A61F 5/0116 482/145 |
| 2012/0133182 | A1 * | 5/2012 | Chiu | A47C 4/54 297/232 |
| 2013/0261510 | A1 * | 10/2013 | Anderson | A47C 1/024 601/5 |
| 2014/0141948 | A1 * | 5/2014 | Aronson | A63B 22/0087 482/128 |
| 2014/0289960 | A1 * | 10/2014 | Hjort | A61G 7/1046 5/83.1 |
| 2016/0317870 | A1 * | 11/2016 | Haas | A63B 26/003 |
| 2016/0375292 | A1 * | 12/2016 | Taft | A63B 23/1281 482/5 |
| 2018/0085621 | A1 * | 3/2018 | Webber | A63B 23/03541 |
| 2019/0083338 | A1 * | 3/2019 | Childs | A61G 5/006 |
| 2019/0351285 | A1 * | 11/2019 | Kwun | A63B 23/025 |
| 2021/0077851 | A1 * | 3/2021 | Ucgun | A63B 21/4031 |
| 2021/0228935 | A1 * | 7/2021 | Duplechain | A63B 21/151 |
| 2022/0192381 | A1 * | 6/2022 | Gervais | A61H 1/02 |

* cited by examiner

EASY CHAIR WITH EXERCISE AND HEALTH BENEFITS

BACKGROUND OF THE INVENTION

The present invention relates generally to chairs and other apparatus for assisting the sitting or reclining body with comfort, exercise, posture, ingress, egress, support, fitness, breathing, sleeping, napping, safety, wellness, stretching, good posture and alleviation or prevention of back and other body pain. Many people do not receive an adequate amount of physical exercise. Physicians, physical fitness experts and health professionals have long recognized the relationship between good health and regular physical exercise. A sedentary lifestyle leads to reduced longevity.

In order to exercise, people often frequent gyms having extensive and expensive exercise equipment or frequent other locations for exercise away from their homes or offices. People also purchase special exercise equipment for their homes or offices and may have special areas or rooms dedicated to exercise. Travel to gyms or other exercise locations requires time and expense and often may not be convenient for many reasons. Special home or office rooms or other dedicated exercise areas are not suitable for many people.

Exercises that can be carried out in the home, office and other places where people normally sit during their regular daily activities is most desirable. Exercises which can be carried out using apparently conventional furniture and non-obtrusive equipment are especially desirable particularly when no special area or dedicated exercise room is available. This objective is even more the case where people have transferred to an aging care or recovery facility.

Prior apparatus for home, office or other locations for facilitating regular exercise have generally not been satisfactory. Prior apparatus does not provide an attractive piece of furniture which can be used as and appear as a normal non-exercise piece of furniture and which also can assist individuals with health benefits including comfort, exercise, posture, ingress, egress, support, fitness, stretching and alleviation or prevention of back and other body pain.

Furniture which allows TV watching, reading, computer use, conversation and other normal activities while also assisting individuals with health benefits is in great need.

In addition to the need for exercise, the need for good posture and support are also important aspects for chairs and other apparatus. Many people have a sedentary lifestyle often sitting in front of a TV, reading or working on a computer or other device. People often sit with the wrong postures for extended periods of time. Most chairs and other seating apparatus pay no attention to or provide no provision for proper pelvic tilt, have no adjustable lumbar and/or neck and head support for alignment, have no side-to side head support for use in napping or sleeping, have improper foot or leg support, have no stability assist when entering (ingress) or leaving (egress) the chair, have restricted range of motion and often cause sedentary inducement.

While vigorous and intense exercise is desirable, particularly with younger people, less intense exercise is also highly desirable for everyone and particularly for older people. In older adults and those with impaired musculoskeletal systems, intense exercise may cause more harm than good. Some motion or moderate exercise is important for toning muscles, providing muscle strength and avoiding muscle injury. As muscle injury increases and muscle tone and strength decrease, a more sedentary lifestyle results. Reduced muscle tone and reduced strength induces fatigue and increases the risk of musculoskeletal injury, or injuries from falling, particularly in obese people. Therefore, it is important for people to have at least low to moderate intensity exercise for maintaining body muscle strength, for increasing circulation, for reducing stress, for better oxygenation and for preventing unnecessary muscle fatigue.

In consideration of the above background, there is a need for improved chairs and other apparatus for providing health benefits.

SUMMARY

The present invention is a seating apparatus having a front, a back and first and second sides and including a seat extending between the front and the back and between the sides, including a back component at the back, including arms extending between the front and the back, including legs where the seating apparatus is cushioned for providing comfortable seating of a body for living room, office and other seating environments. The seating apparatus includes a frame for the seat, for the back component, for the arms and legs and includes one or more supports fixed with respect to the frame and extending from the seating apparatus to provide stationary anchors for use by the body with the seating apparatus.

In one embodiment, at least one of the supports is located near the front of the apparatus and extends from an arm to a position above the arm and above the seat. In some embodiments, the supports are rods attach to the frame near the front of the apparatus with caps at the ends of the rods at a position above the arm and above the seat. In some embodiments, the caps are at a height whereby the support is available to be grasped to stabilize a body during ingress or egress from the seating apparatus. In other embodiments, the supports provide devices to be grabbed by the hands or provide anchors for exercise bands (resistance bands) to be used by the body for exercise.

In one embodiment, inflatable cushions are provided with the seating apparatus. A control module connects to a pump to control the inflation levels of the cushions to provide proper pelvic tilt, to provide adjustable lumbar and/or neck and head support for alignment. The inflatable cushions are used in combination with the reclining of the chair where the combination of the tilt and the cushions provide health benefits for a ExerStyle Chair. In another embodiment, the control module connects to a motor or motors which position panels to support the cushions to do the above, In one embodiment, the chair has a tray table which is adjustable to provide for proper positioning for use as a meal tray, writing or reading table or a laptop computer or other device which is adjustable to provide best posture while in use. The tray table also permits the chair to be used as a workstation enabling work to be carried out in proper posture and enabling use the exercise features from time to time.

The foregoing and other objects, features and advantages of the invention will be apparent from the following detailed description in conjunction with the drawings.

DETAILED DESCRIPTION

Figure 1:
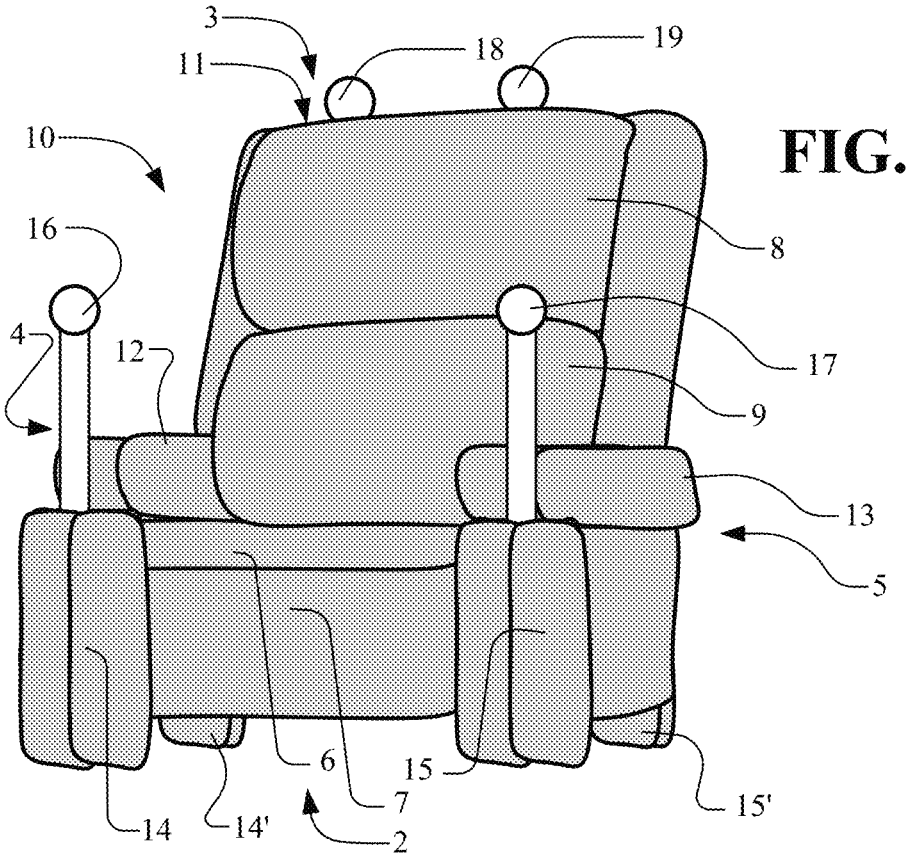
FIG. 1 depicts a front perspective view of a seating apparatus in the form of an easy chair, motion chair, recliner or lift chair.

In FIG. 1, a front perspective view is shown of a seating apparatus in the form of an easy chair 10. The easy chair 10 includes a front 2, a back 3, a first side 4 and a second side 5. A seat 6 extends from the front 2 to the back 3 between the side 4 and the side 5. The seat 6 is cushioned to provide easy chair comfort. A front panel 7 extends between the leg 14 and the leg 15 and below the cushion 6. The arm 12 is along the side 4 and the arm 13 is along the side 5. The cushion 8 and the cushion 9 are part of the back component 11. The front leg 14 is in the front on the side 4 and the front leg 15 is in the front on the side 5. The back leg 14' is in the back on the side 4 and the back leg 15' is in the back on the side 5. A rigid support 16 is in the front on the side 4 and a rigid support 17 is in the front on the side 5. The support 16 and the support 17 are attached to the frame (see FIG. 2) of the easy chair 10. A rigid support 18 is in the back nearer the side 4 and a rigid support 19 is in the back nearer the side 5. The support 18 and the support 19 are attached to the frame (see FIG. 2) of the easy chair 10. The term "support" is intended to mean any item of manufacture that performs a function of supporting, stabilizing, securing or otherwise assisting a human body in connection with using a seating apparatus such as a chair, bed or similar equipment.

The chair of FIG. 1 can be used at all times as a normal piece of furniture. The supports 16, 17, 18 and 19 can be ignored, retracted, hidden or removed. When the supports 16, 17, 18 and 19 are present and used, the chair provides health benefits including comfort, exercise, posture, ingress, egress, support, fitness, stress reduction, stretching and alleviation or prevention of back and other body pain. The normal parts of a chair or other apparatus include a seat, a back component, a first arm and a second arm, legs and a frame to hold the other parts together. A support is a member that extends from one or more of the parts of a chair or other seating apparatus to provide a stationary anchor to facilitate the exercising and/or supporting of the body beyond what is facilitated by the normal parts of the chair or other seating apparatus. The stationary anchor provides a resistance for exercise. The resistance of the support is through an exercise band (resistance band) or is by direct holding (grasping in the hand) or by direct contact (pushing with a foot) with the body.

Figure 2:
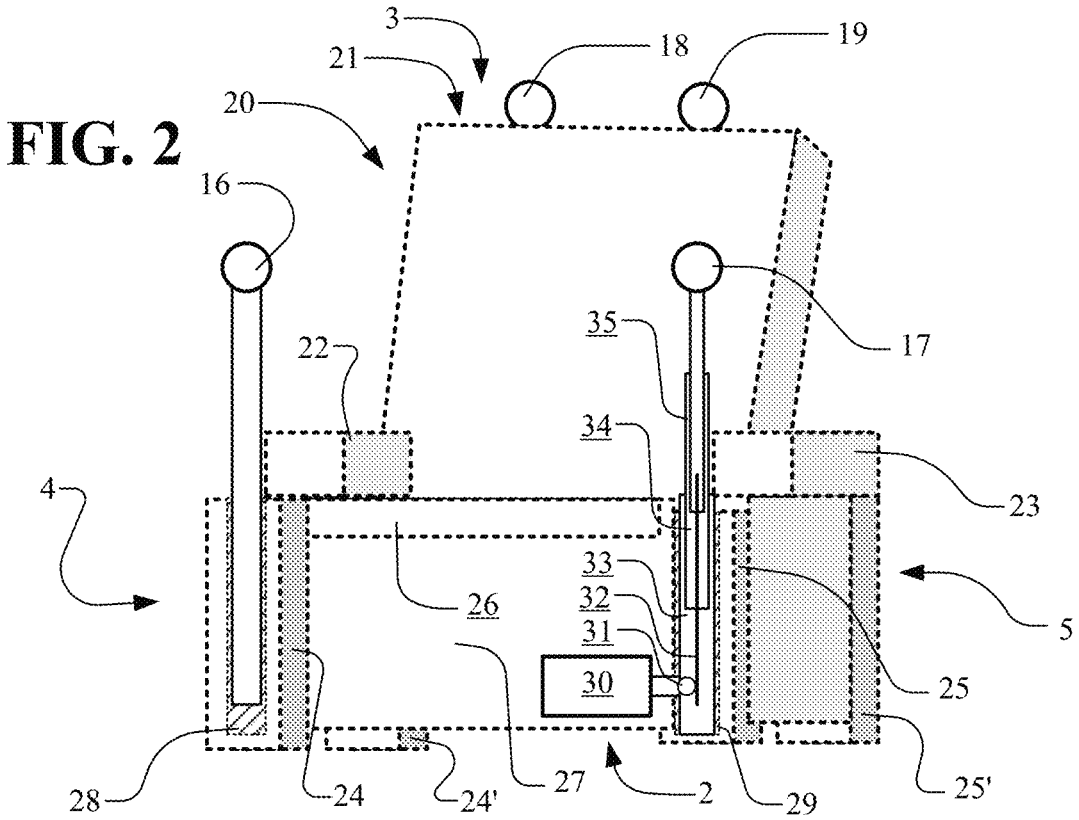
FIG. 2 depicts a front perspective view of a frame for the chair of FIG. 1.

In FIG. 2, a front perspective view is shown of a typical frame 20 for the chair 10 of FIG. 1. The frame is constructed of plywood or other furniture material and provides a structure for attachment to and rigidly holding the supports 16, 17, 18 and 19 and the other supports described in this specification.

In FIG. 2, the frame 20 of the easy chair 10 of FIG. 1 includes a front 2, a back 3, a first side 4 and a second side 5. A seat frame 26 extends from the front 2 to the back 3 between the side 4 and the side 5. The seat frame 26 is for receiving cushions or cushioning to provide easy chair comfort. The arm frame 22 is along the side 4 and the arm frame 23 is along the side 5. The front leg frame 24 is in the front on the side 4 and the front leg frame 25 is in the front on the side 5. The back leg frame 24' is in the back on the side 4 and the back leg frame 25' is in the back on the side 5. A front panel frame 27 extends between the leg frame 14 and the leg frame 15 and below the seat frame 26. A rigid support 16 is in the front on the side 4 and a rigid support 17 is in the front on the side 5. The support 16 and the support 17 are attached to the frame 20. Support 16 is attached to the frame by tube 28 within the leg frame 24. The tube 28 is bolted, epoxied or otherwise fixed to the leg frame 24. The support 16, in one embodiment, slides tightly within the tube 28 so that the support 16 provides a rigid, fixed-length post for use by a chair user. The support 17 is attached to the frame by tube 29 within the leg frame 25. The tube 29 is bolted, epoxied or otherwise fixed to the leg frame 25. The support 17, in one embodiment, is telescoping so as to be extendable at different heights. A motor 30 drives a gear 31 to drive a drive shaft 32. The drive shaft 32 drives telescoping members 34 and 35 within the shaft 33. The support 17, and any or all of the other supports in this specification, can be non-movable or movable. Movable supports can be manually movable or power-driven movable. Any of the movable supports can be set at one or more adjustable positions to meet the needs of bodies of different sizes and to facilitate different exercises.

A rigid support 18 is in the back nearer the side 4 and a rigid support 19 is in the back nearer the side 5. The support 18 and the support 19 are attached to the frame 20 and particularly the back frame component 21.

Figure 3:
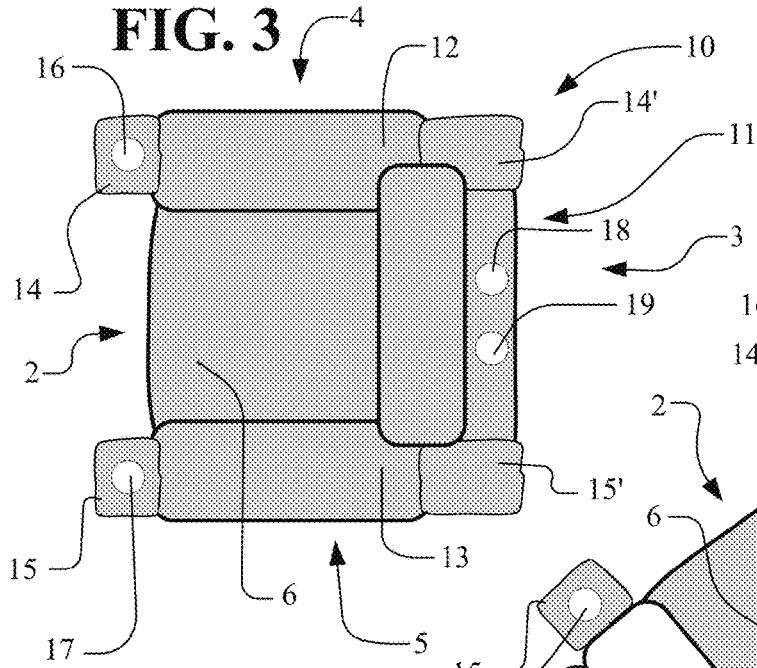
FIG. 3 depicts a top view of the chair of FIG. 1.

In FIG. 3, a top view is shown of the easy chair 10 of FIG. 1. The easy chair 10 includes a front 2, a back 3, a first side 4 and a second side 5. A seat 6 extends from the front 2 toward the back 3 between the side 4 and the side 5. The seat 6 is cushioned to provide easy chair comfort. The arm 12 is along the side 4 and the arm 13 is along the side 5. The back component 11 is toward the rear 3 behind the seat cushion 6. The front leg 14 is in the front on the side 4 and the front leg 15 is in the front on the side 5. The back leg 14' is in the back on the side 4 and the back leg 15' is in the back on the side 5. A rigid support 16 is in the front on the side 4 and a rigid support 17 is in the front on the side 5. The support 16 and the support 17 are attached or otherwise fixed relative to the frame 20 of FIG. 2. A rigid support 18 is in the back nearer the side 4 and a rigid support 19 is in the back nearer the side 5. The support 18 and the support 19 are attached to or otherwise fixed relative to the reclining or reclinable frame 20 of FIG. 2.

Figure 4:
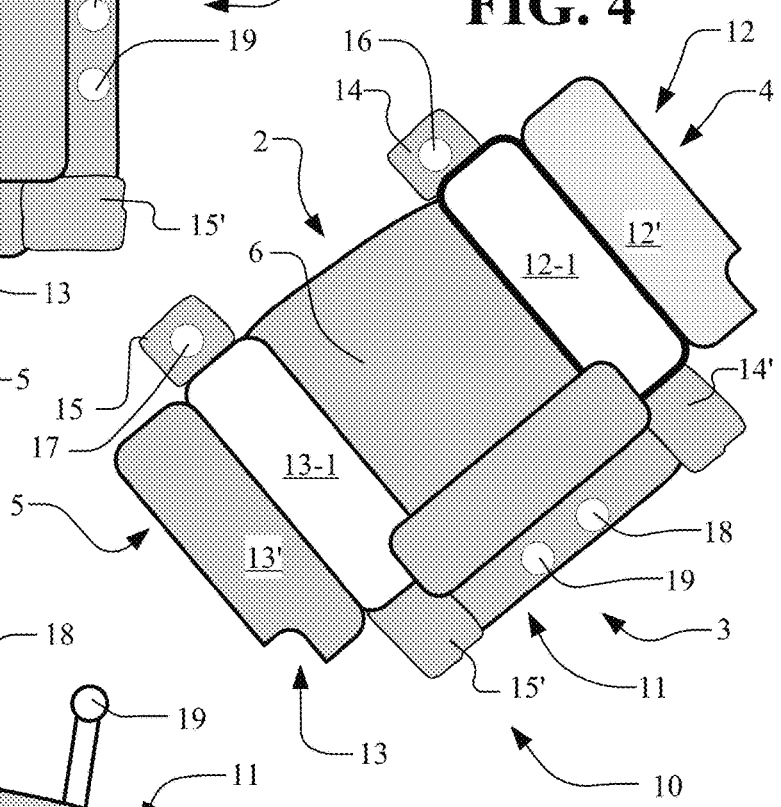
FIG. 4 depicts a top view of the chair of FIG. 1 with covers to the arms open.

In FIG. 4, a top view of the chair 10 of FIG. 1 is shown with cover 13' and cover 14' open for arm 13 and arm 14, respectively. The easy chair 10 includes a front 2, a back 3, a first side 4 and a second side 5. A seat 6 extends from the front 2 toward the back 3 between the side 4 and the side 5. The seat 6 is cushioned to provide easy chair comfort. The arm 12 is along the side 4 and the arm 13 is along the side 5. The back component 11 is toward the rear 3 behind the seat cushion 6. The front leg 14 is in the front on the side 4 and the front leg 15 is in the front on the side 5. The back leg 14' is in the back on the side 4 and the back leg 15' is in the back on the side 5. A rigid support 16 is in the front on the side 4 and a rigid support 17 is in the front on the side 5. The support 16 and the support 17 are attached to or otherwise fixed relative to the frame 20 of FIG. 2. A rigid support 18 is in the back nearer the side 4 and a rigid support 19 is in the back nearer the side 5. The support 18 and the support 19 are attached to or otherwise fixed relative to the reclining or reclinable frame 20 of FIG. 2. With the cover 12' and cover 13' open, storage compartment 12-1 and storage compart 13-1 for the arm 12 and arm 13, respectively, are revealed. The storage compartment 12-1 and storage compart 13-1 may include dividers or other partitioning (not shown) for storage of exercise bands and other exercise equipment, drinks, sundries, telephones, medicines, blood pressure and other monitors and other items convenient to be close at hand. Typically exercise information, instructions on using the chair and other information are also included in the compartments so as to be close at hand.

Figure 5:
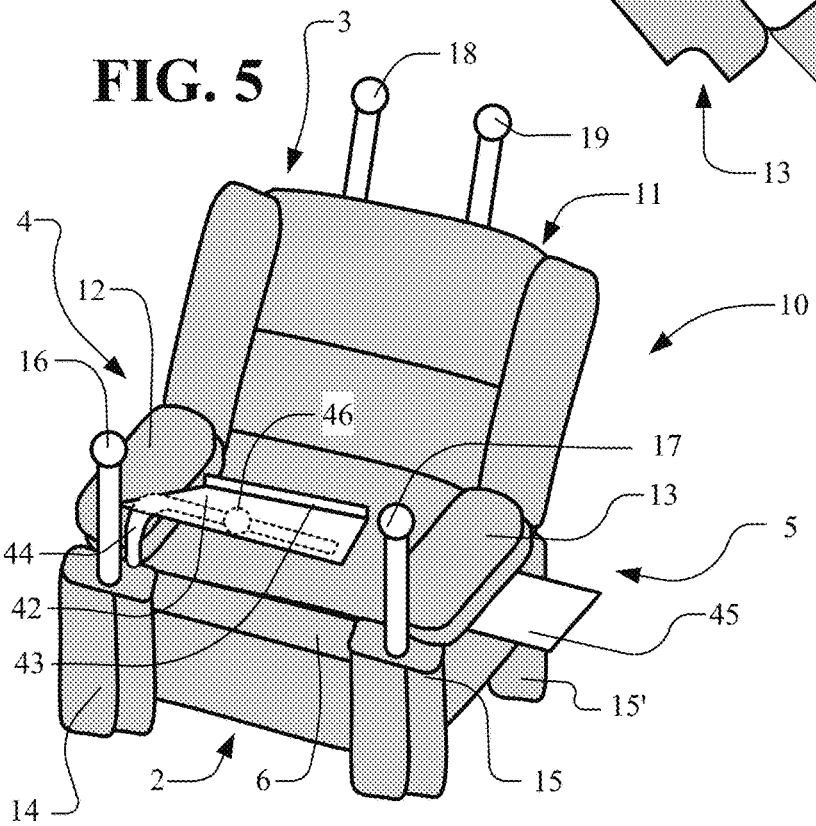
FIG. 5 depicts a front perspective view of the chair of FIG. 1 with a stand and tray.

In FIG. 5, a front perspective view of the chair 10 of FIG. 1 with a stand 44 and tray 42. The easy chair 10 includes a front 2, a back 3, a first side 4 and a second side 5. A seat 6 extends from the front 2 toward the back 3 between the side 4 and the side 5. The seat 6 is cushioned to provide easy chair comfort. The arm 12 is along the side 4 and the arm 13 is along the side 5. The back component 11 is toward the rear 3 behind the seat cushion 6. The front leg 14 is in the front on the side 4 and the front leg 15 is in the front on the side 5. The back leg 14' is in the back on the side 4 and the back leg 15' is in the back on the side 5. A rigid support 16 is in the front on the side 4 and a rigid support 17 is in the front on the side 5. The support 16 and the support 17 are attached to or otherwise fixed relative to the frame 20 of FIG. 2. A rigid support 18 is in the back nearer the side 4 and a rigid support 19 is in the back nearer the side 5. The support 18 and the support 19 are attached to or otherwise fixed relative to the frame 20 of FIG. 2. The stand 44 extends into the chair and is supported by the frame 20 of FIG. 2. The stand 44 supports the tray 42 on a rotational mount 46. The tray 42 includes a back elevated edge 43 to prevent books, computers, trays and other things support on the tray from falling off the back edge of the tray 42 when tray 42 is tilted. A tray 45 extends from the side 5 and is convenient for drinks, medicine, a computer mouse and other items convenient to be close at hand.

Figure 6:
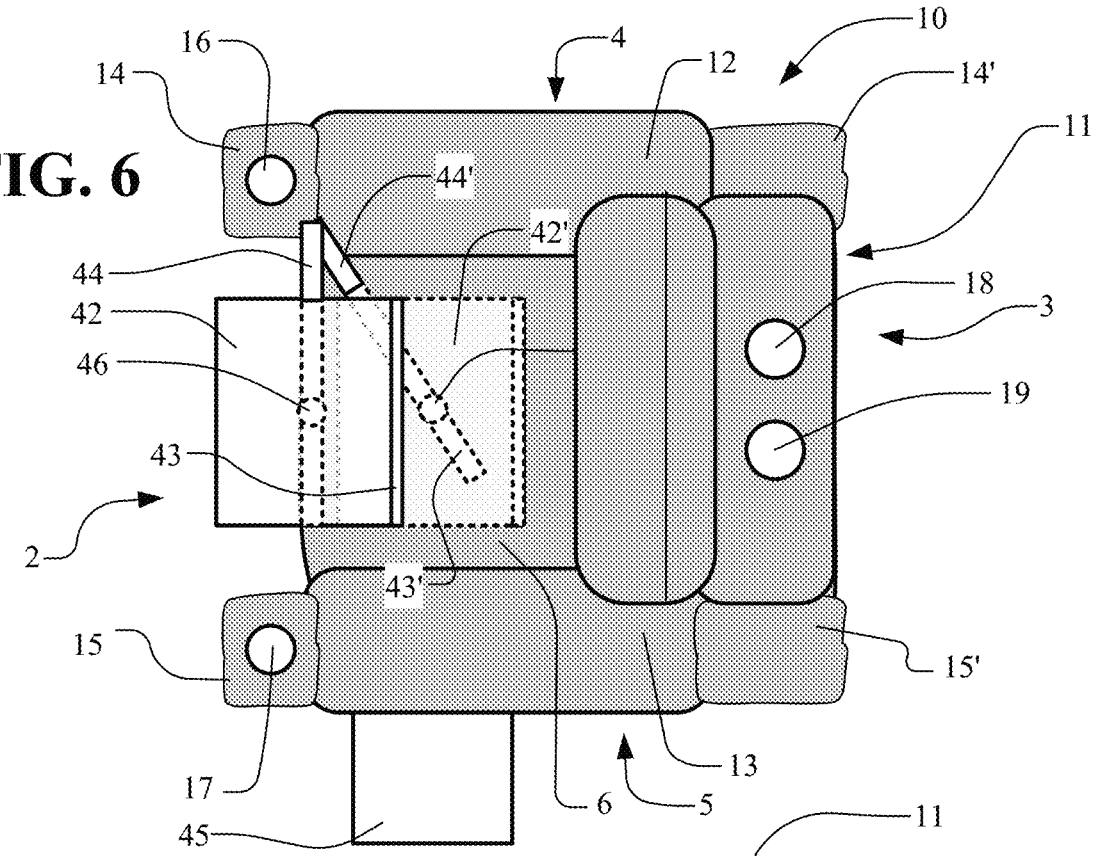
FIG. 6 depicts a top view of the chair of FIG. 5.

In FIG. 6, a top view of the easy chair 10 of FIG. 5 is shown. The easy chair 10 includes a front 2, a back 3, a first side 4 and a second side 5. A seat 6 extends from the front 2 toward the back 3 between the side 4 and the side 5. The seat 6 is cushioned to provide easy chair comfort. The arm 12 is along the side 4 and the arm 13 is along the side 5. The back component 11 is toward the rear 3 behind the seat cushion 6. The front leg 14 is in the front on the side 4 and the front leg 15 is in the front on the side 5. The back leg 14' is in the back on the side 4 and the back leg 15' is in the back on the side 5. A rigid support 16 is in the front on the side 4 and a rigid support 17 is in the front on the side 5. The support 16 and the support 17 are attached to or otherwise fixed relative to the frame 20 of FIG. 2. A rigid support 18 is in the back nearer the side 4 and a rigid support 19 is in the back nearer the side 5. The support 18 and the support 19 are attached to or otherwise fixed relative to the frame 20 of FIG. 2. A tray 45 extends from the side 5 and is convenient for drinks, medicine, a computer mouse and other items convenient to be close at hand. The stand 44 extends into the chair and is supported by the frame 20 of FIG. 2 and is adjustable in height by a frictional fit or by other common adjustment means. The stand 44 supports the tray 42 on a rotational mount 46. The stand 44 rotates so that the tray 42 can translate back and forth. The tray 42 includes a back elevated edge 43 to prevent books, computers, trays and other things supported on the tray from falling off the back edge of the tray 42 when tray 42 is tilted. The tray 42 is shown by broken lines translated back to a position 42' by rotation of the stand 44' and the with the tray 42' having rotated around the rotational mount 46'. The positional adjustments possible for tray 42 allow computers, books and other items on the tray 42 to be positioned so that a body in the chair using those items has good posture and comfort.

Figure 7:
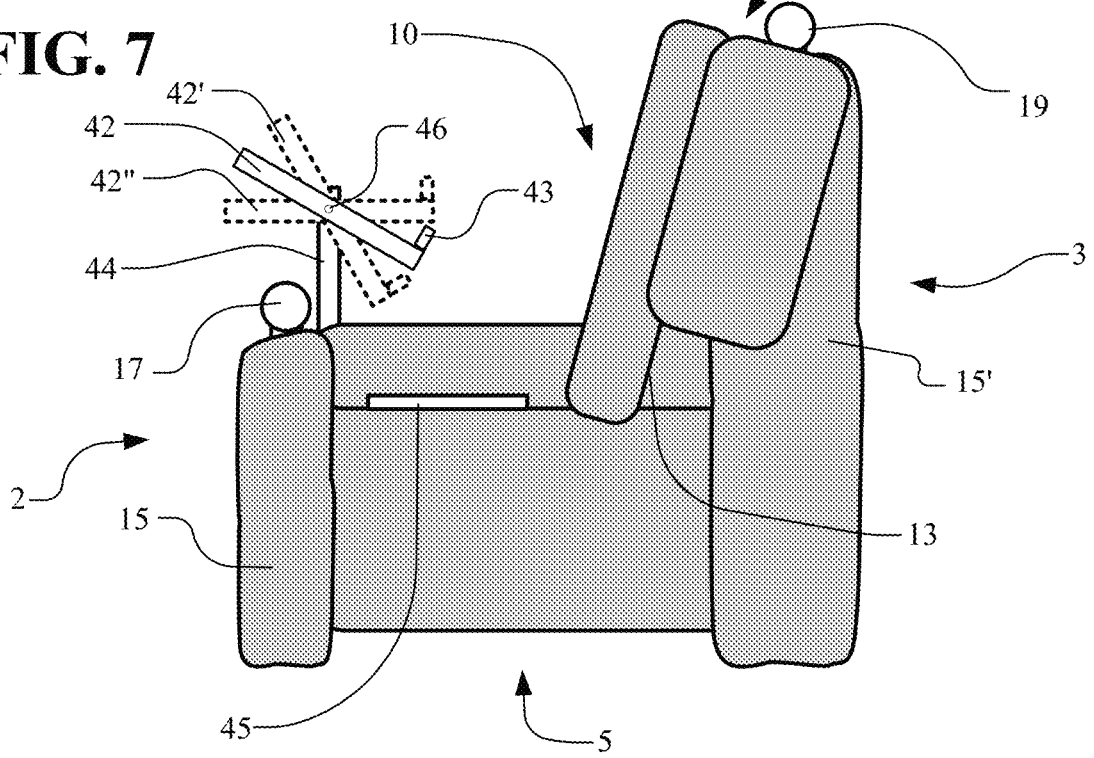
FIG. 7 depicts a side view of the chair of FIG. 5.

In FIG. 7, a side view of the easy chair 10 of FIG. 5 is shown. The easy chair 10 includes a front 2, a back 3 and a side 5. The arm 13 is along the side 5. The back component 11 is toward the rear 3. The front leg 15 is in the front on the side 5. The back leg 15' is in the back on the side 5. A rigid support 17 is in the front on the side 5. A rigid support 19 is in the back nearer the side 5. The stand 44 extends into the chair 10. The stand 44 supports the tray 42 on a rotational mount 46. The tray 42 is shown rotated to the phantom positions as indicated by tray 42' and tray 42". The rotation of the tray 42 together with the other positional adjustments possible for tray 42 as described in connection with FIG. 6 allow computers, books and other items on the tray 42 to be positioned so that a body in the chair using those items has good posture and comfort. The tray 42 includes a back elevated edge 43 to prevent books, computers, trays and other things supported on the tray from falling off the back edge of the tray 42 when tray 42 is tilted. A tray 45 extends from the side 5 and is convenient for drinks, medicine, a computer mouse and other items convenient to be close at hand.

Figure 8:
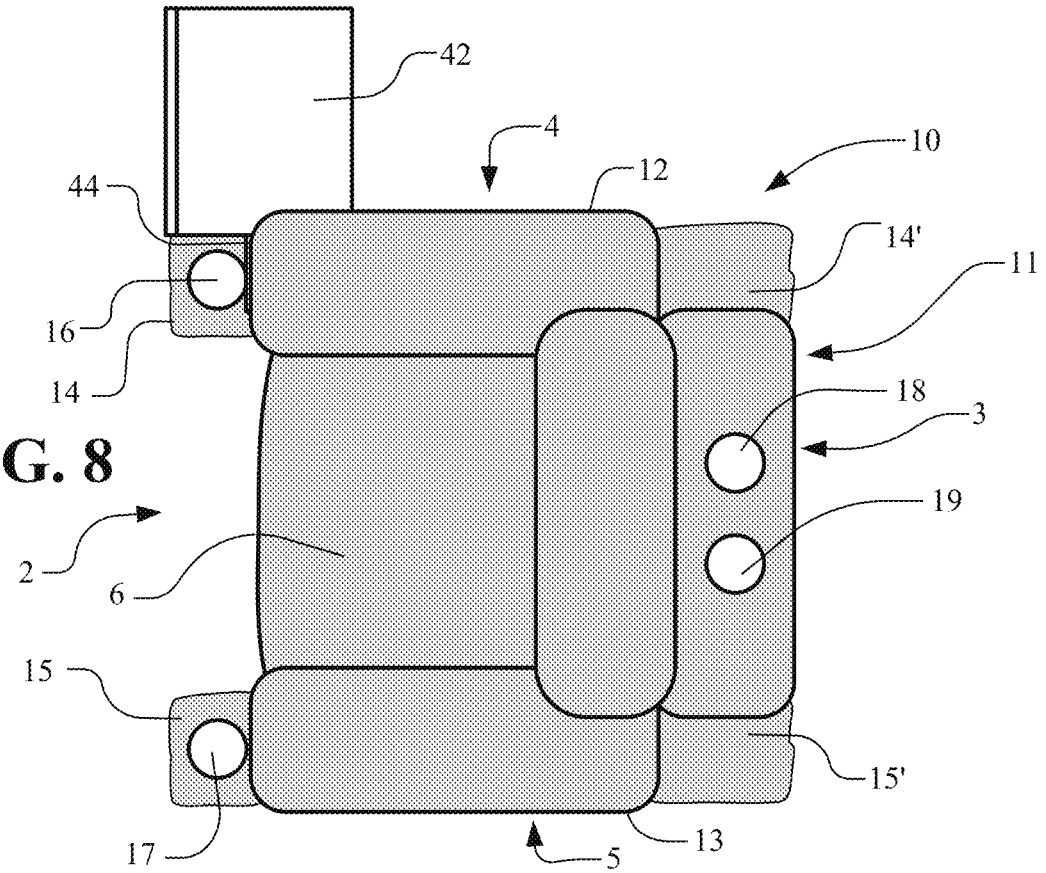
FIG. 8 depicts a top view of the chair of FIG. 5 with the tray rotated to the side.

In FIG. 8, a top view of the easy chair 10 of FIG. 5 is shown with the tray 42 rotated to the side 4. The easy chair 10 includes a front 2, a back 3, a first side 4 and a second side 5. A seat 6 extends from the front 2 toward the back 3 between the side 4 and the side 5. The arm 12 is along the side 4 and the arm 13 is along the side 5. The back component 11 is toward the rear 3 behind the seat cushion 6. The front leg 14 is in the front on the side 4 and the front leg 15 is in the front on the side 5. The back leg 14' is in the back on the side 4 and the back leg 15' is in the back on the side 5. A rigid support 16 is in the front on the side 4 and a rigid support 17 is in the front on the side 5. A rigid support 18 is in the back nearer the side 4 and a rigid support 19 is in the back nearer the side 5. The stand 44 supports the tray 42.

Figure 9:
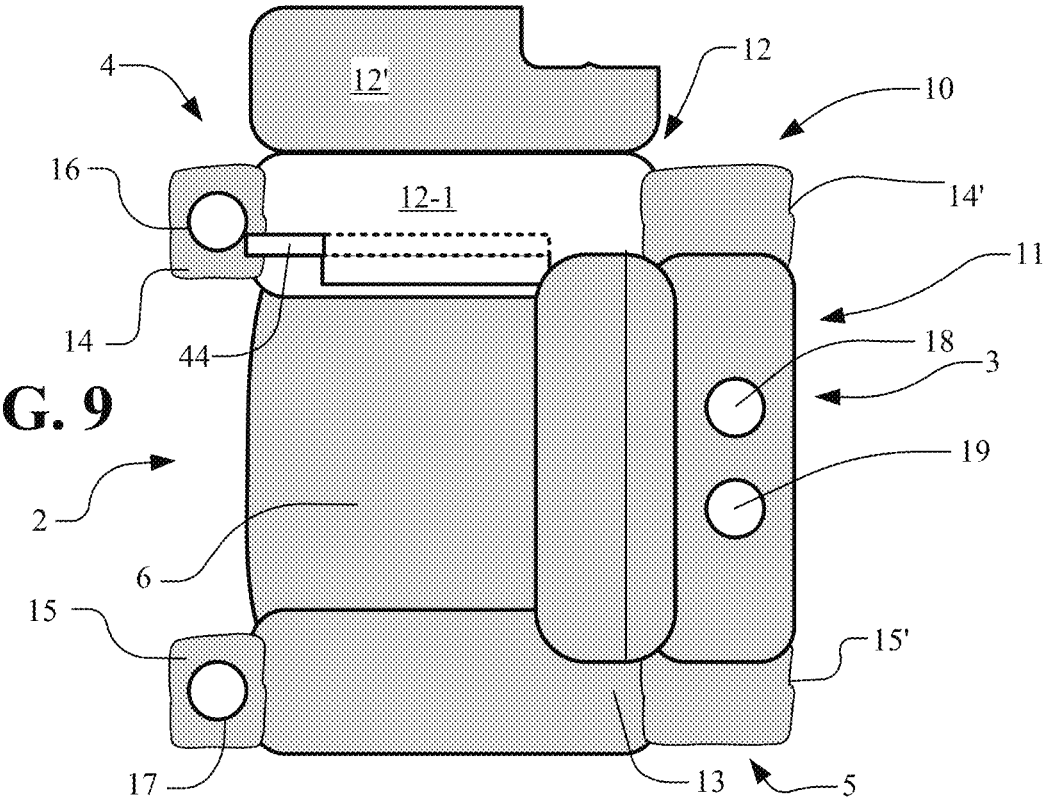
FIG. 9 depicts a top view of the chair of FIG. 5 with the tray inserted into an arm compartment.

In FIG. 9, a top view of the easy chair 10 of FIG. 5 is shown with the tray 42 inserted into the arm compartment 12-1 with the arm cover 12' open. The stand 44 supports the tray 42 and is rotatable to insert the tray 42 into the bin 12-1. Alternatively, tray 42 is removable from the chair 10 and insertable into the bin 12-1 or otherwise stored. The easy chair 10 includes a front 2, a back 3, a first side 4 and a second side 5. A seat 6 extends from the front 2 toward the back 3 between the side 4 and the side 5. The arm 12 is along the side 4 and the arm cover 12' is open to reveal the storage bin 12-1. The arm 13 is along the side 5. The back component 11 is toward the rear 3 behind the seat cushion 6. The front leg 14 is in the front on the side 4 and the front leg 15 is in the front on the side 5. The back leg 14' is in the back on the side 4 and the back leg 15' is in the back on the side 5. A rigid support 16 is in the front on the side 4 and a rigid support 17 is in the front on the side 5. A rigid support 18 is in the back nearer the side 4 and a rigid support 19 is in the back nearer the side 5.

Figure 10:
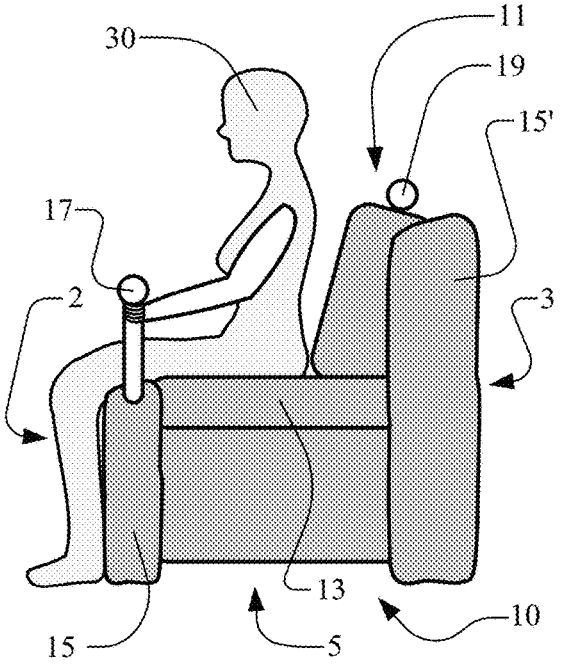
FIG. 10 depicts a side view of the chair of FIG. 1 with a sitting body grabbing a support extending from an arm of the chair.

In FIG. 10, a side view of the easy chair 10 of FIG. 1 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. A sitting body 30 is grabbing support 17. The body 30 is sitting away from the back component 11 using the support 17 for assisting exercise or an egress from the chair 10.

Figure 11:
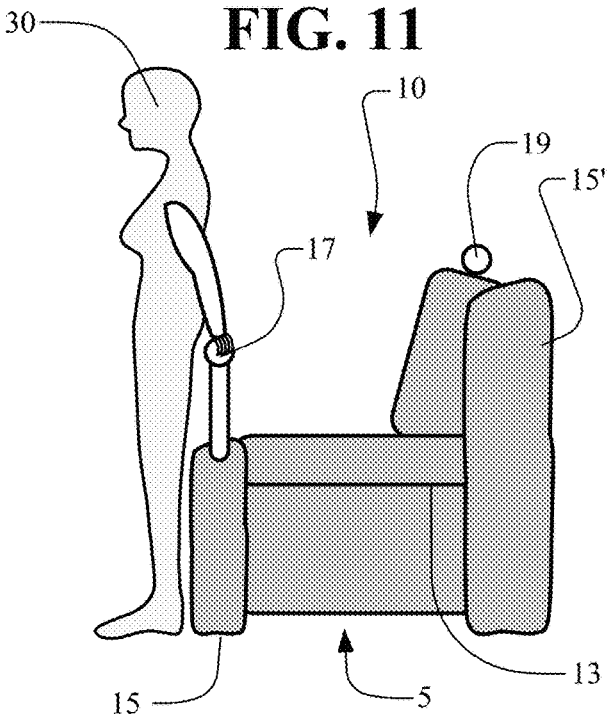
FIG. 11 depicts a side view of the chair of FIG. 10 with a standing body grabbing a support extending from an arm of the chair.

In FIG. 11, a side view of the easy chair 10 of FIG. 10 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The standing body 30 is grabbing the support 17 after egress from the chair 10. Use of the support 17 steadies and stabilizes the body 30 and is particularly useful for infirmed and older people with limited mobility. The support 17 allows the body to pull itself forward, assists the body in standing up, and keeps the body stabilized as it reaches a standing position and while the body reaches, if necessary, for an assisting person, walker or other device. The chair 10 is particularly safe and good for those with Parkinson's disease or neuropathy.

Figure 12:
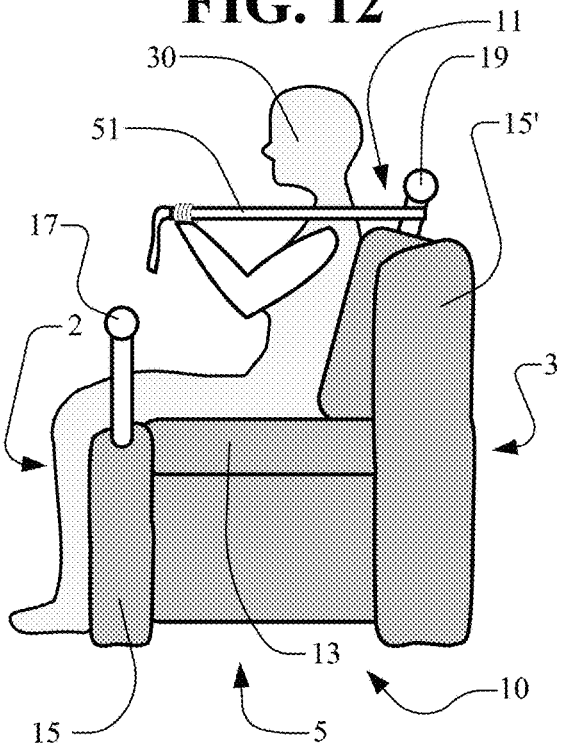
FIG. 12 depicts a side view of the chair of FIG. 1 with a sitting body holding an exercise band anchored around supports extending from the back of the chair.

In FIG. 12, a side view of the easy chair 10 of FIG. 1 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The sitting body 30 holds an exercise band 51 anchored around support 19 (and support 18, not shown, see FIG. 5) extending from the back 3 of the chair 10. The exercise band 51 is held tightly by the body and is used for exercise of the body's arms 30-1 by pushing away from the back 3 toward the front 2 and then relaxing from toward the front 2 to toward the back 3 in a repeating motion.

Figure 13:
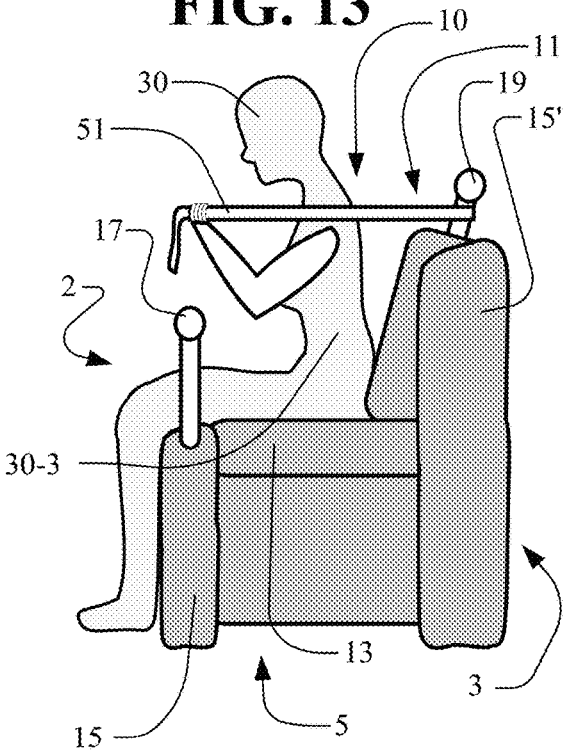
FIG. 13 depicts a side view of the chair of FIG. 12 with a sitting body holding an exercise band anchored around supports extending from the back of the chair and with the body leaning forward to stretch the exercise band.

In FIG. 13, a side view of the easy chair 10 of FIG. 12 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The sitting body 30 holds the exercise band 51 anchored around support 19 (and support 18, not shown, see FIG. 5) extending from the back 3 of the chair 10. The body 30 is leaning forward toward the front 2 of the chair 10 to stretch the exercise band 51 using and exercising the torso 30-3. After exercising forward as shown in FIG. 13, the body 30 can return to the back position as shown in FIG. 12. The forward and backward motion can be repeated in an exercise routine to exercise the region of the torso 30-3 of body 30.

Figure 14:
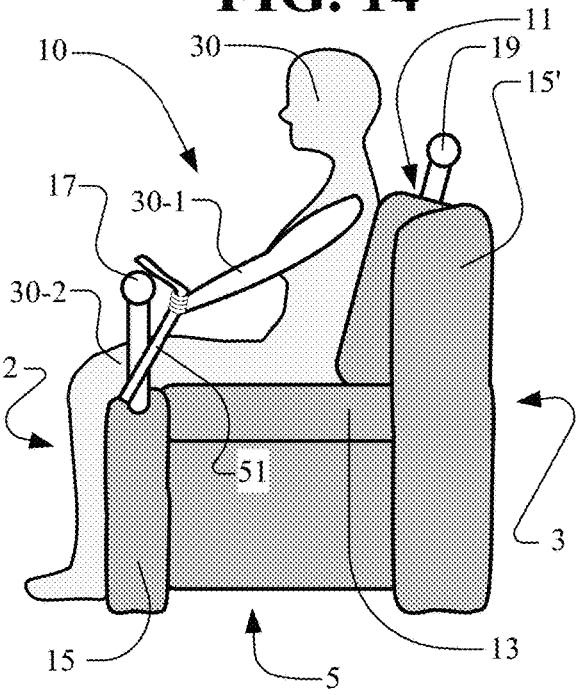
FIG. 14 depicts a side view of the chair of FIG. 1 with a sitting body holding an exercise band anchored around supports extending from arms of the chair and under the legs of the body.

In FIG. 14, a side view of the easy chair 10 of FIG. 1 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The sitting body 30 holds an exercise band 51 anchored around support 17 and under the body's leg 30-2. The exercise band 51 is held tightly by the body's hands and arms 30-1 and is used for exercise through use of the body's arms 30-1.

Figure 15:
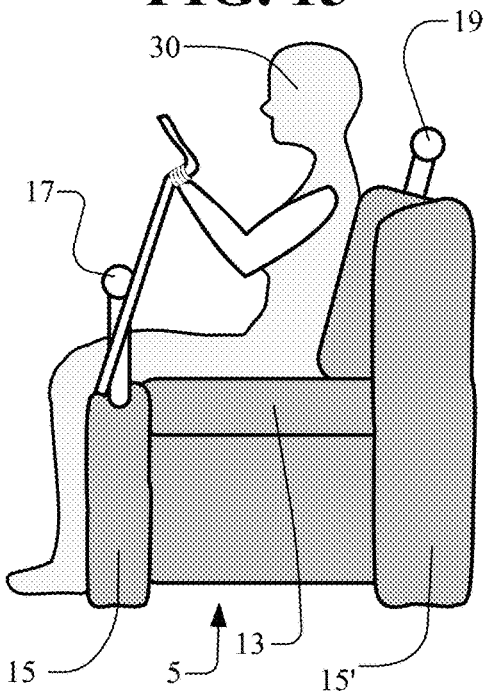
FIG. 15 depicts a side view of the chair of FIG. 14 with a sitting body holding an exercise band anchored around supports extending from arms of the chair and under the legs of the body and with the arms of the body raised to stretch the band for exercise.

In FIG. 15, a side view of the easy chair 10 of FIG. 14 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The sitting body 30 holds the exercise band 51 anchored around support 17 and under the body's leg 30-2. The arms 30-1 in FIG. 15 are raised from the position in FIG. 14 to stretch the band 51 for exercise using the arms 30-1. The up and down motion of the arms 30-1 as depicted in FIG. 14 and FIG. 15 is repeated in an exercise routine to exercise the arms 30-1, shoulders and upper back of the body 30.

Figure 16:
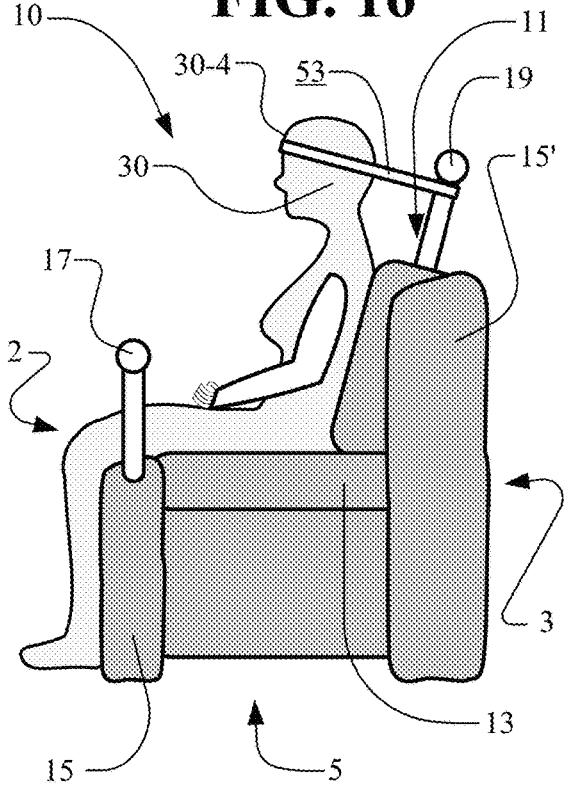
FIG. 16 depicts a side view of the chair of FIG. 1 with a sitting body having an exercise band around her head and anchored around supports extending from the back of the chair.

In FIG. 16, a side view of the easy chair 10 of FIG. 1 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The sitting body 30 has a loop exercise band 53 around her forehead 30-4 and anchored around support 19 (and support 18, not shown, see FIG. 5) extending from the back 3 of the chair 10. The body 30 holds the band 53 taught.

Figure 17:
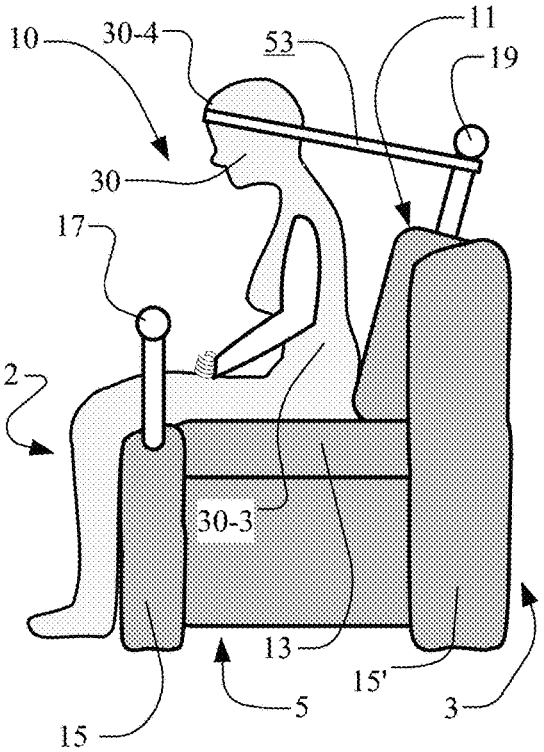
FIG. 17 depicts a side view of the chair of FIG. 16 with a sitting body having an exercise band around her head and anchored around supports extending from the back of the chair and with the body leaning forward to stretch the band for exercise.

In FIG. 17, a side view of the easy chair 10 of FIG. 16 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The sitting body 30 has an exercise band 53 around her forehead 30-4 and is leaning forward to stretch the band 53 for exercise of the body 30 in the region of the torso 30-3. The back and forth motion of the body between the positions as depicted in FIG. 16 and FIG. 17 is repeated in an exercise routine to exercise the torso 30-3 and the body's back and other muscles.

Figure 18:
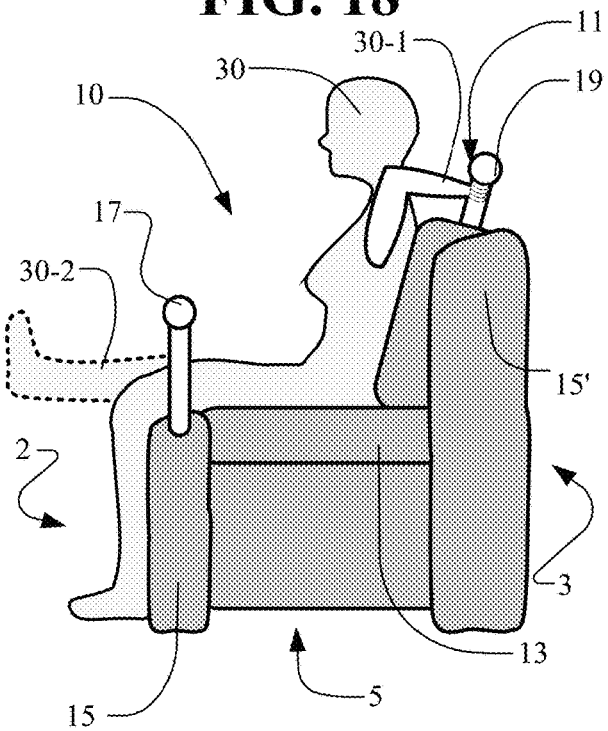
FIG. 18 depicts a side view of the chair of FIG. 1 with a sitting body holding supports extending from the back of the chair for pulling against the supports for exercise.

In FIG. 18, a side view of the chair 10 of FIG. 1 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 (and support 18, not shown, see FIG. 5) is in the back nearer the side 5. The supports 18 and 19 extend from the back of the chair 30 and are used by the arms 30-1 for pulling against the supports for exercise. The body 30 exercises the leg 30-2 by lifting from the floor to a raised position. The lifting of the leg 30-2 from the floor to the raised position is repeated in an exercise routine to exercise the leg 30-2 muscles and other muscles.

Figure 19:
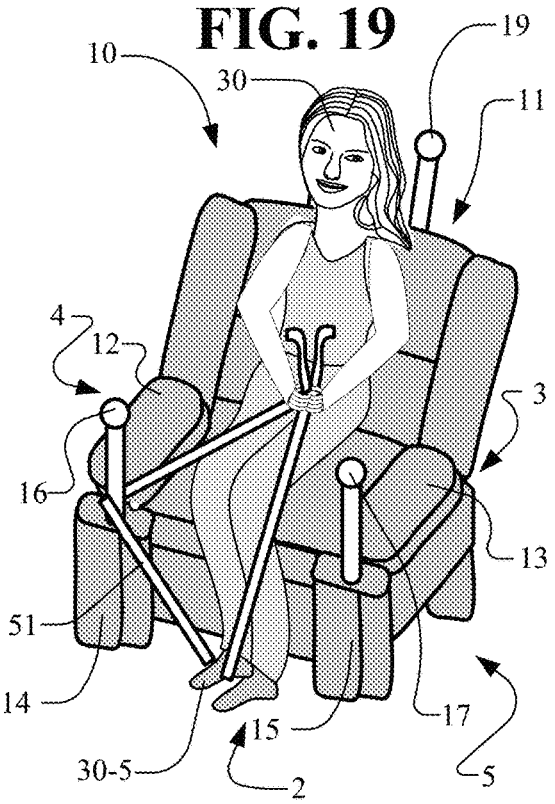
FIG. 19 depicts a front perspective view of the chair of FIG. 1 with a body holding a band around a support and under a foot.

In FIG. 19, a front perspective view of the easy chair 10 of FIG. 1 is shown. The easy chair 10 includes a front 2, a back 3, a side 4 and a side 5. The arm 13 is along the side 5. The back component 11 is toward the rear 3. The front leg 15 is in the front on the side 5 and the back leg 15' is in the back on the side 5. A rigid support 16 is in the front on the side 4 and a rigid support 17 is in the front on the side 5. A rigid support 19 is in the back nearer the side 5. The sitting body 30 has a band 51 extending around support 16 and under a foot 30-5.

Figure 20:
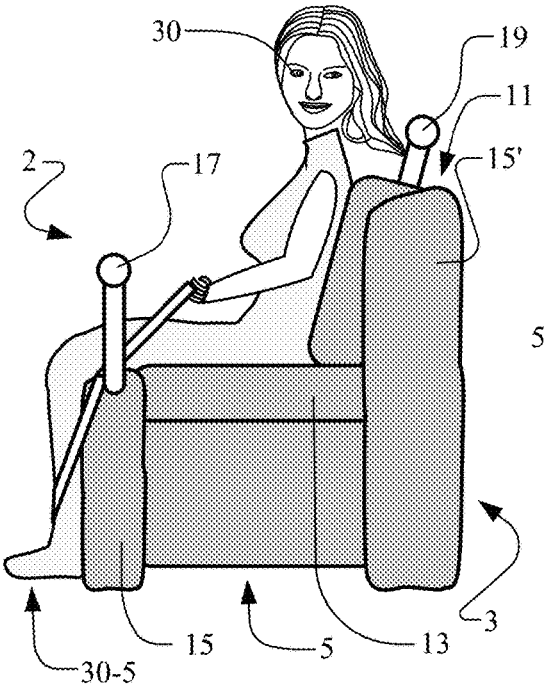
FIG. 20 depicts a side view of the chair of FIG. 19 with a body holding a band around a support and under a foot.

In FIG. 20, a side view of the easy chair 10 of FIG. 19 is shown. The easy chair 10 includes a front 2, a back 3 and a side 5. The arm 12 is along the side 4 and the arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The sitting body 30 has a band 51 extending around support 16 and under a foot 30-5.

Figure 21:
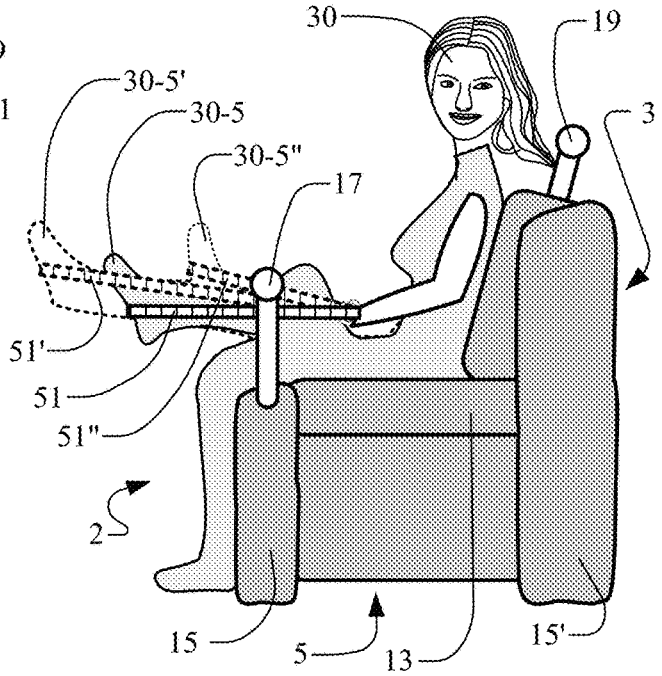
FIG. 21 depicts a side view of the chair of FIG. 20 with a body holding a band under a foot and raised for exercise.

In FIG. 21, a side view of the easy chair 10 of FIG. 20 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The body 30 holds a band 51 under a foot 30-5. With tension in the band 51 the raised leg 30-5 is extended outward to the position of phantom leg 30-5' and then withdrawn inward to the position of phantom leg 30-5". The extension and retraction of the leg 30-2 from the position of phantom leg 30-5' to the position of phantom leg 30-5" is repeated in an exercise routine to exercise the leg 30-2.

Figure 22:
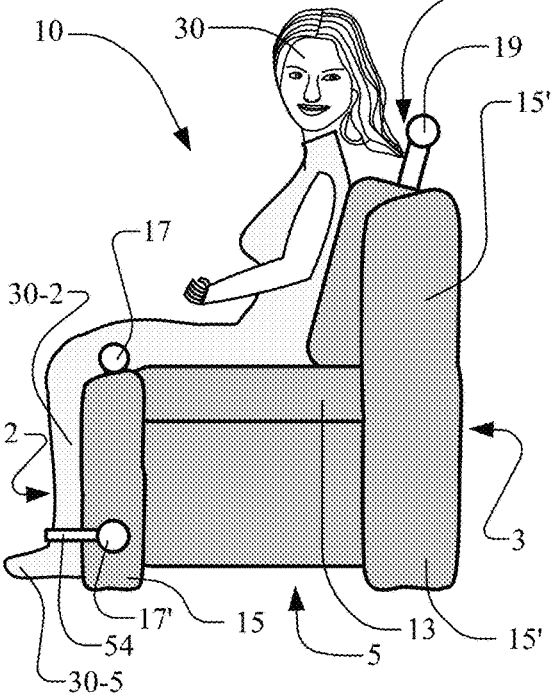
FIG. 22 depicts a side view of an easy chair having a side support with a sitting body having a band around a foot and anchored to a side support.

In FIG. 22, a side view of an easy chair 10 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The chair 10 has a side support 17' on the side 5. A sitting body 30 has a band 54 around a foot 3-5 and anchored to the side support 17'.

Figure 23:
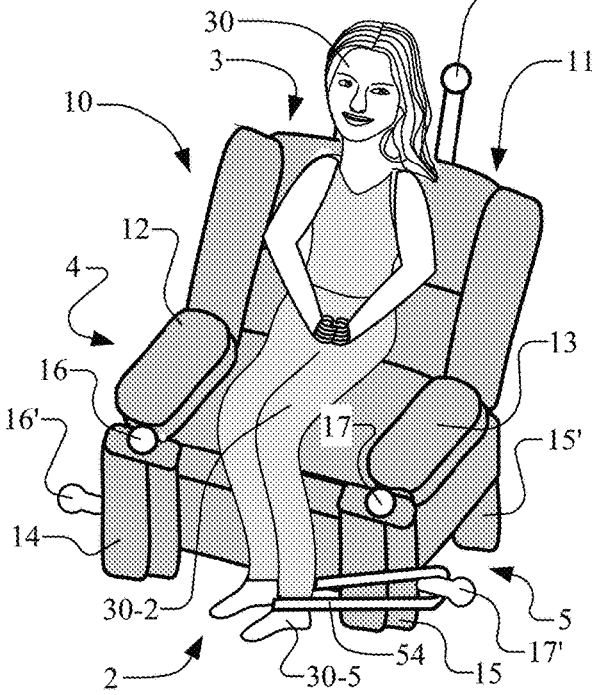
FIG. 23 depicts a front perspective view of the easy chair of FIG. 22 with a sitting body having a band around a foot and anchored to a side support.

In FIG. 23, a front perspective view of the easy chair 10 of FIG. 22 is shown. The easy chair 10 includes a front 2, a back 3, a side 4 and a side 5. The arm 12 is along the side 4 and the arm 13 is along the side 5. The back component 11 is toward the rear 3. The front leg 15 is in the front on the side 5 and the back leg 15' is in the back on the side 5. A rigid support 16 is in the front on the side 4 and a rigid support 17 is in the front on the side 5. A rigid support 19 is in the back nearer the side 5. A sitting body 30 has a band 54 around a foot 30-5 and anchored to the side support 17'. In FIG. 23, leg 30-2 has stretched the band 54 to exercise the leg 30-2 muscles. After the stretch in FIG. 23, the foot 30-5 is returned toward the support 17' as shown in FIG. 22. The stretching and return of the leg 30-2 is repeated in an exercise routine to exercise the leg 30-2.

Figure 24:
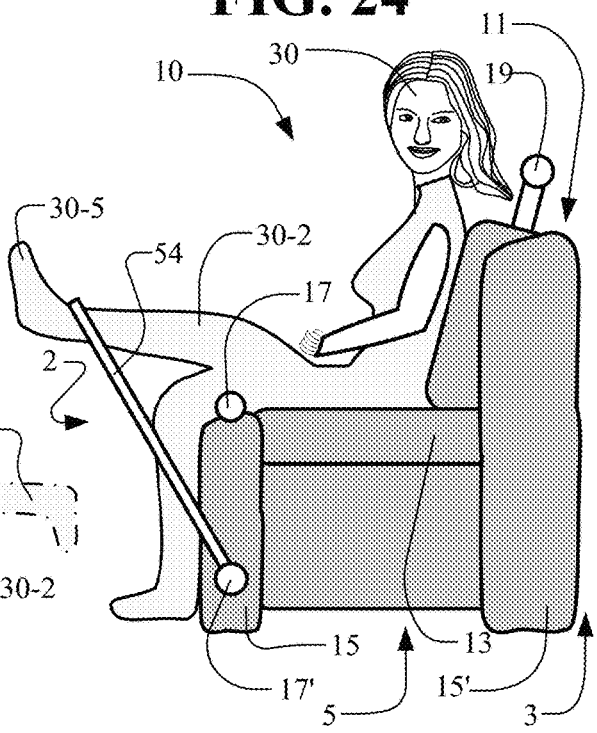
FIG. 24 depicts a side view of the easy chair of FIG. 22 with a sitting body having a band anchored to a side support and with the leg lifted for exercise.

In FIG. 24, a side view of the easy chair 10 of FIG. 22 and FIG. 23 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The chair 10 has a side support 17' on the side 5. A sitting body 30 has a band 54 around a foot 30-5 and anchored to the side support 17'. The leg 30-2 is raised against the restraint of the band 54 for exercise of leg 30-2. The raising and the lowering of the leg 30-2, from the position of FIG. 22 and FIG. 23 to the position of FIG. 24, is repeated in an exercise routine to exercise the leg 30-2.

Figure 25:
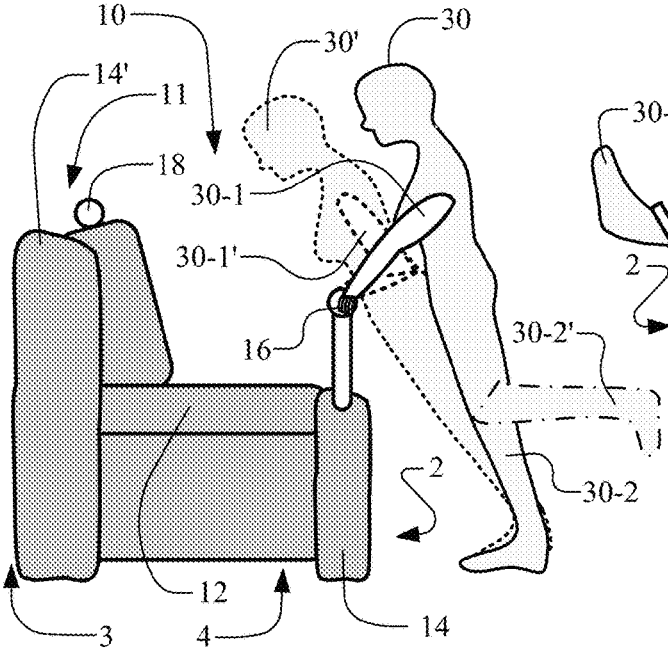
FIG. 25 depicts a side view of the easy chair of FIG. 1 with a body not sitting in the chair using supports for exercise.

In FIG. 25, a side view of the easy chair 10 of FIG. 1 is shown. The easy chair 10 includes a front 2, a back 3 and a side 4. The arm 12 is along the side 4. The back component 11 is toward the rear 3. The front leg 14 is in the front on the side 4 and the back leg 14' is in the back on the side 4. A rigid support 16 is in the front on the side 4. A rigid support 18 is in the back nearer the side 4. A body 30 has arms 30-1 extended holding the support 16. The body 30 bends the arms to a position shown by phantom arm 30-1'. The extension and retraction of the position of body 30 to the position of body 30', by the extension and retraction from the position of arm 30-1 to the position of arm 30-1', is repeated in an exercise routine to exercise the arms 30-1. FIG. 25 also depicts a lower leg lift exercise. One leg is shown down and standing at one time at the position of leg 30-2 and then is shown lifted at the position of phantom leg 30-2'. Thereafter the leg at phantom position 30-2' is returned to the position of leg 30-2. The lifting and return is repeated in an exercise routine to exercise the hamstring muscles. These exercises of FIG. 25 are representative of one example of the exercises that are performed using the easy chair 10 when the body 30 is not sitting in the chair 10 but is using the supports on the chair.

Figure 26:
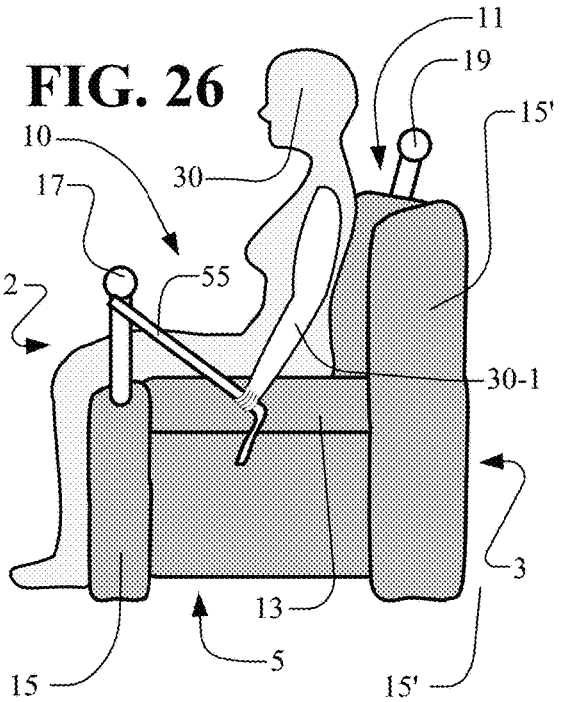
FIG. 26 depicts a side view of the chair of FIG. 1 with a sitting body holding an exercise band anchored around supports extending from arms of the chair.

In FIG. 26, a side view of the easy chair 10 of FIG. 1 is shown. The easy chair 10 includes a front 2, a back 3 and a side 5. The arm 13 is along the side 5. The back component 11 is toward the rear 3. The front leg 15 is in the front on the side 5 and the back leg 15' is in the back on the side 5. A rigid support 17 is in the front on the side 5. A rigid support 19 is in the back nearer the side 5. The sitting body 30 holds a band 55 under tension against support 17 for exercising.

Figure 27:
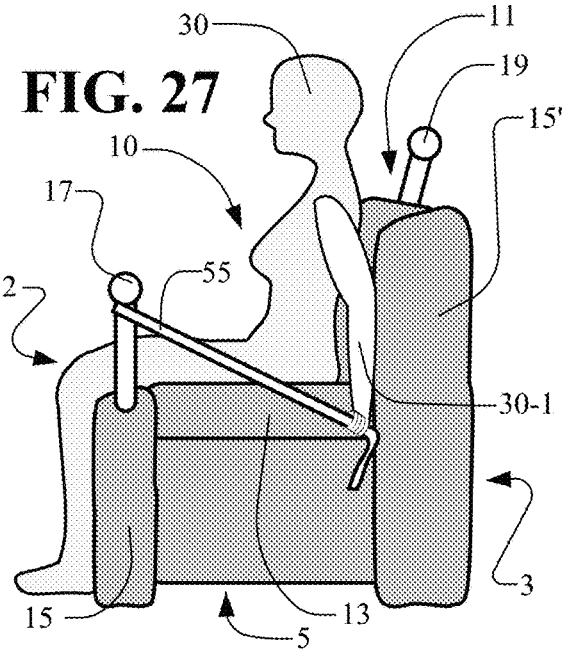
FIG. 27 depicts a side view of the chair of FIG. 26 with a sitting body holding an exercise band stretched downward for exercise.

In FIG. 27, a side view of the easy chair 10 of FIG. 26 is shown. The easy chair 10 includes a front 2, a back 3 and a side 5. The arm 13 is along the side 5. The back component 11 is toward the rear 3. The front leg 15 is in the front on the side 5 and the back leg 15' is in the back near the side 5. A rigid support 17 is in the front on the side 5. A rigid support 19 is in the back nearer the side 5. The sitting body 30 holds a band 55 moved toward the back 3 under tension against support 17. The moving of the band 55 between the position of FIG. 26 and the position of FIG. 27 is repeated in an exercise routine to exercise the arm 30-1 and the muscles of the body 30 connected to arm 30-1.

Figure 28:
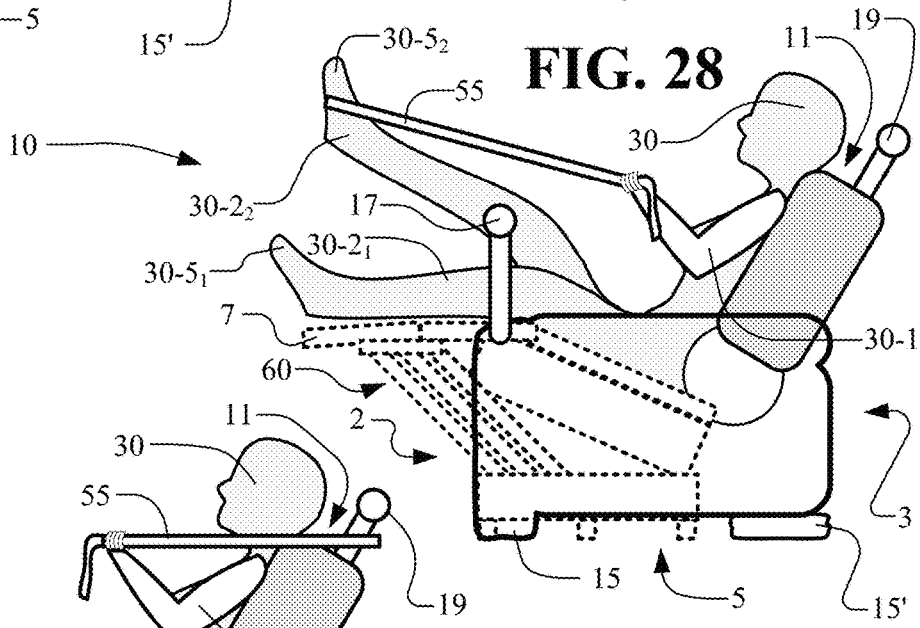
FIG. 28 depicts a side view of a reclining chair with a reclined body holding an exercise band around a foot.

In FIG. 28, a side view of a reclining easy chair 10 is shown. The easy chair 10 includes a front 2, a back 3 and a side 5. The back component 11 is toward the rear 3. The front leg 15 is in the front on the side 5 and the back leg 15' is in the back near the side 5. A rigid support 17 is in the front on the side 5. A rigid support 19 is in the back nearer the side 5. The chair 10 is reclined with the back component 11 tilted backward toward the back 3. The front panel 7 is raised to raise the leg 30-2$_1$ and the leg 30-2$_2$. The reclined and sitting body 30 holds a band 55 around a foot 30-5 on leg 30-2$_2$ under tension. For one exercise, the leg 30-2$_2$ and foot 30-5 are extended and retracted similar to the movement shown in FIG. 21 or for another exercise, the leg 30-2$_2$ is lowered to the position of leg 30-2$_1$ and then again raised to the position shown in FIG. 28. The moving of the leg 30-2$_2$ either by extending and retracting or by lowering and raising, or combinations thereof is repeated in exercise routines to exercise the leg 30-2$_2$. Of course, leg 30-2$_1$ is exercised in the same manner.

Figure 29:
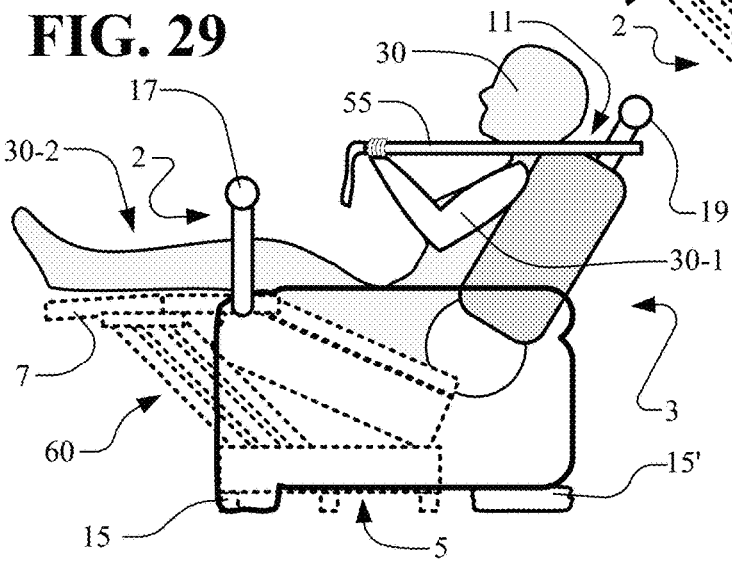
FIG. 29 depicts a side view of a reclining chair with a reclined body holding an exercise band anchored by supports in the back of the chair.

In FIG. 29, a side view of a reclining easy chair 10 is shown. The easy chair 10 includes a front 2, a back 3 and a side 5. The front leg 15 is in the front on the side 5 and the back leg 15' is in the back near the side 5. A rigid support 17 is in the front on the side 5. A rigid support 19 is in the back nearer the side 5 (together with a support 18, not shown, see FIG. 5). The chair 10 is reclined with the back component 11 tilted backward toward the back 3. The front panel 7 is raised to raise the legs 30-2. The sitting body 30 holds a band 55 under tension against support 19 (and support 18, not shown, see FIG. 5). The supports 18 and 19 extend from the back of the chair 30 and are used by the arms 30-1 for pulling forward against the band 55 toward the front 2 and releasing the band 55 toward the rear 3 for exercise. The pulling and releasing are repeated in an exercise routine.

Figure 30:
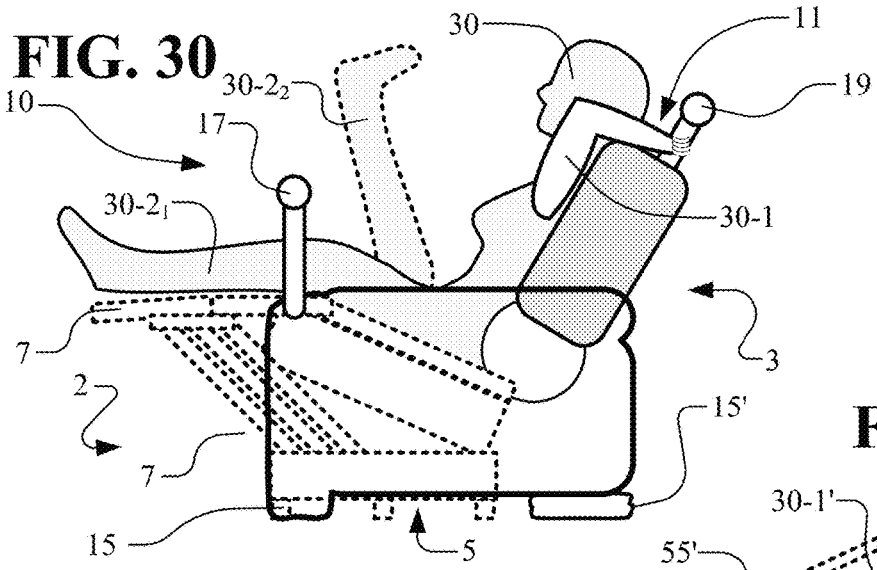
FIG. 30 depicts a side view of a reclining chair with a reclined body holding supports in the back of the chair and with the body doing a leg lift exercise.

In FIG. 30, a side view of a reclining easy chair 10 is shown. The easy chair 10 includes a front 2, a back 3 and a side 5. The front leg 15 of the chair 10 is in the front on the side 5 and the back leg 15' of the chair 10 is in the back near the side 5. A rigid support 17 is in the front on the side 5. A rigid support 19 is in the back nearer the side 5 (together with a support 18, not shown, see FIG. 5). The chair 10 is reclined with the back component 11 tilted backward toward the back 3. The front panel 7 is raised to raise the leg 30-2$_1$. The sitting body 30 holds support 19 (and support 18, not shown). The supports 18 and 19 extend from the back of the chair 30 and are used by the arms 30-1 for pulling and releasing against the supports 18 and 19 for exercise. The body 30 exercises the leg 30-2$_2$ in a leg lift by lowering the leg 30-2$_2$ down to the panel 7 to the same position as the position of leg 30-2$_1$ and then raising leg 30-2$_2$ to the raised position (shown phantom by broken line in FIG. 30). Of course, leg 30-2$_1$ is exercised in the same manner as leg 30-2$_2$. The pulling and releasing and the raising and lowering are repeated in exercise routines.

Figure 31:
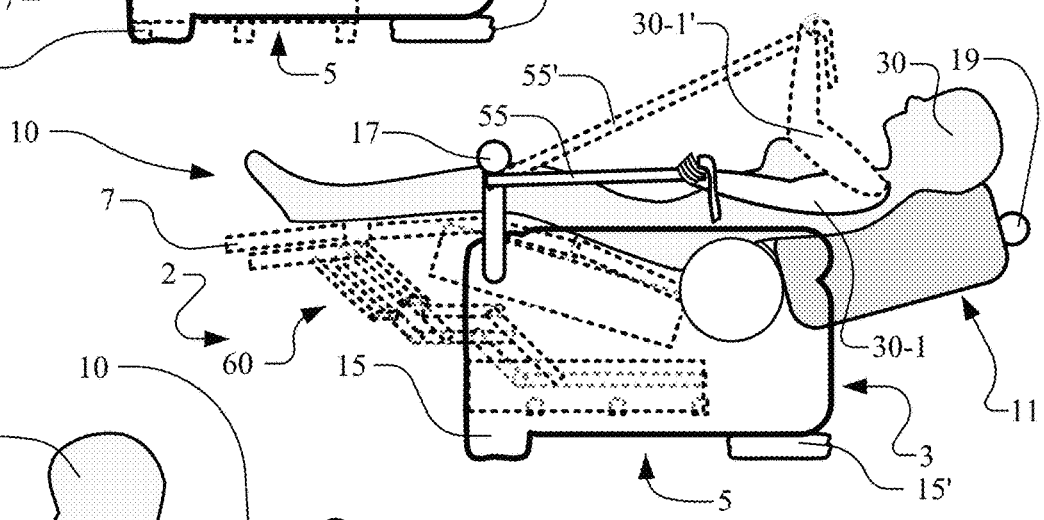
FIG. 31 depicts a side view of a reclining chair fully reclined and supporting a body.

In FIG. 31, a side view of a reclining chair 10 is shown. The easy chair 10 includes a front 2, a back 3 and a side 5. The front leg 15 of the chair 10 is in the front on the side 5 and the back leg 15' of the chair 10 is in the back near the side 5. A rigid support 17 is in the front on the side 5. A rigid support 19 is in the back nearer the side 5. The chair 10 is reclined with the back component 11 tilted backward toward the back 3. The front panel 7 is raised to raise the legs 30-2. The sitting body 30 holds the band 55 anchored by the support 17 (and support 16, not shown, see FIG. 5). The body 30 exercises the arms 30-1 by stretching from the position of band 55 to the phantom position 55' and then returning to the position of band 55. The stretching and returning are repeated in exercise routines.

Figure 32:
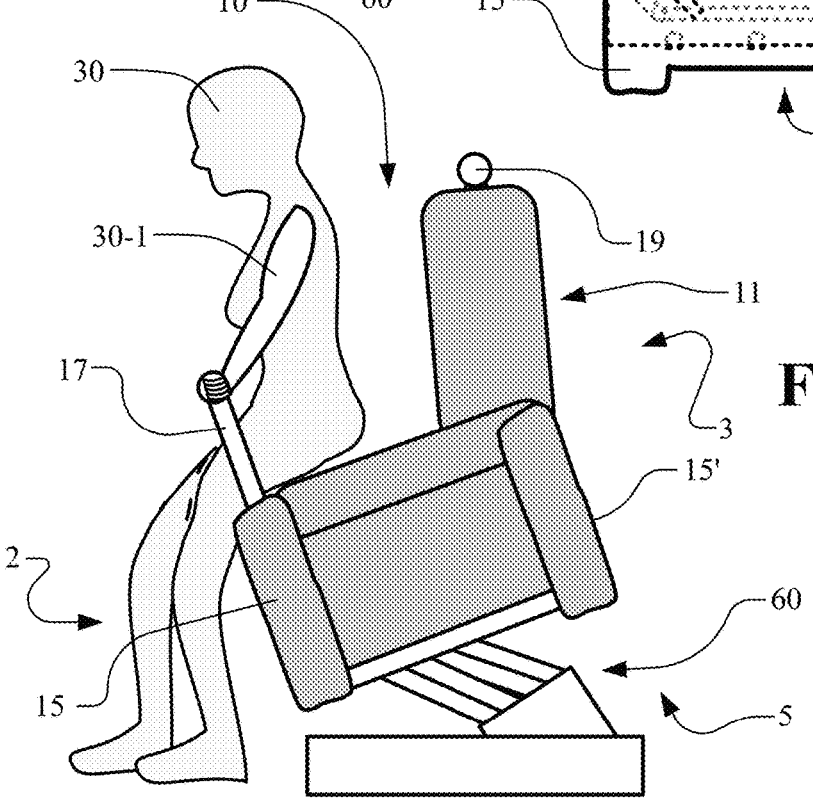
FIG. 32 depicts a side view of a tilting chair tilting forward with a body preparing to stand and using a support for stabilizing.

In FIG. 32, a side view of a forward tilting easy chair 10 is shown. The easy chair 10 includes a front 2, a back 3 and a side 5. The front leg 15 of the chair 10 is in the front on the side 5 and the back leg 15' of the chair 10 is in the back near the side 5. A rigid support 17 is in the front on the side 5. The chair 10 is inclined with the entire chair 10 is raised and tilted forward, including the back component 11, toward the front 2. The sitting body 30 is lifted forward and urged toward the front 2 and, for stability, the sitting body 30 holds the support 17 in preparation for an egress from the chair 10. The body 30 is preparing to stand and use support 17 for stability.

Figure 33:
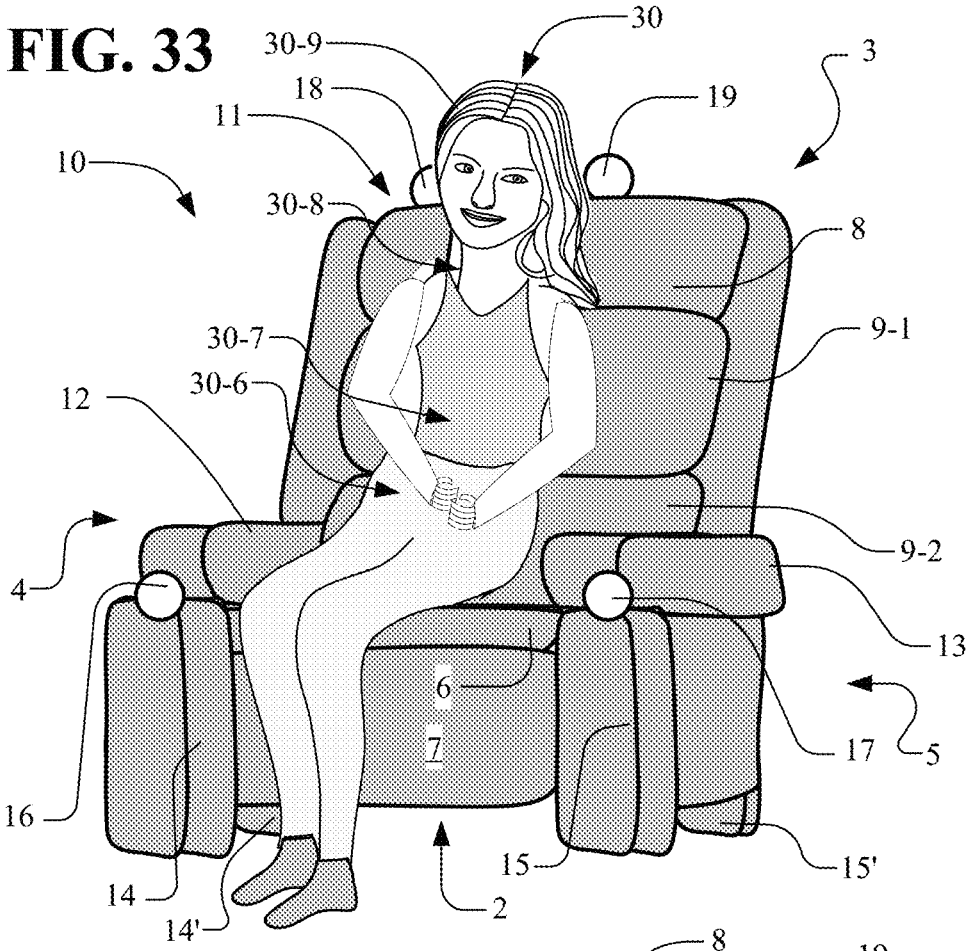
FIG. 33 depicts a perspective view of an easy chair having adjustable cushions.

In FIG. 33, a perspective view of an easy chair 10 is shown having adjustable cushions 8, 9-1 and 9-2. The easy chair 10 includes a front 2, a back 3, a first side 4 and a second side 5. A seat 6 extends from the front 2 toward the back 3 between the side 4 and the side 5. The seat 6 is cushioned to provide easy chair comfort. A front panel 7 extends between the leg 14 and the leg 15 and below the cushion 6. The arm 12 is along the side 4 and the arm 13 is along the side 5. The cushions 8, 9-1 and 9-2 are part of the back component 11. The front leg 14 of the chair is in the front on the side 4 and the front leg 15 is in the front on the side 5. The back leg 14' is in the back on the side 4 and the back leg 15' is in the back on the side 5. A rigid support 16 is in the front on the side 4 and a rigid support 17 is in the front on the side 5. A rigid support 18 is in the back nearer the side 4 and a rigid support 19 is in the back nearer the side 5.

In FIG. 33, the body 30 has a pelvic region 30-6, a lumbar region 30-7, a neck region 30-8 and a head 30-9. The cushions 8, 9-1 and 9-2 (and cushion 9-3, not shown, see FIG. 34) are adjustable to provide a pelvic tilt in the pelvic region 30-6, to adjust support in the lumbar region 30-7, to adjust support in the neck region 30-8 and to adjust support for the head 30-9.

The cushions 8, 9-1 and 9-2 (and cushion 9-3, see FIG. 34) help to provide proper pelvic tilt, help to provide proper lumbar support, help to provide proper neck support and help to support the head 30-9 for proper alignment. The proper support and alignment is established by trial and error until the best comfort is achieved for each individual body. The proper support and alignment can be established through consultation with doctors and other health professional. Also, the cushions help to provide side-to-side head support for use in napping or sleeping, help to provide foot and leg support, help to provide stability and assistance when entering (ingress) or leaving (egress) the chair, help to provide increased range of motion and help to avoid sedentary inducement. Also, the inflatable cushions 8, 9-1 and 9-2 (and cushion 9-3, see FIG. 34) and the reclining chair, shown in FIG. 28 and FIG. 29, for example, when used in combination with a tray, as shown in FIG. 5 through FIG. 7, for example, help to provide proper posture and other health benefits.

Figure 34:
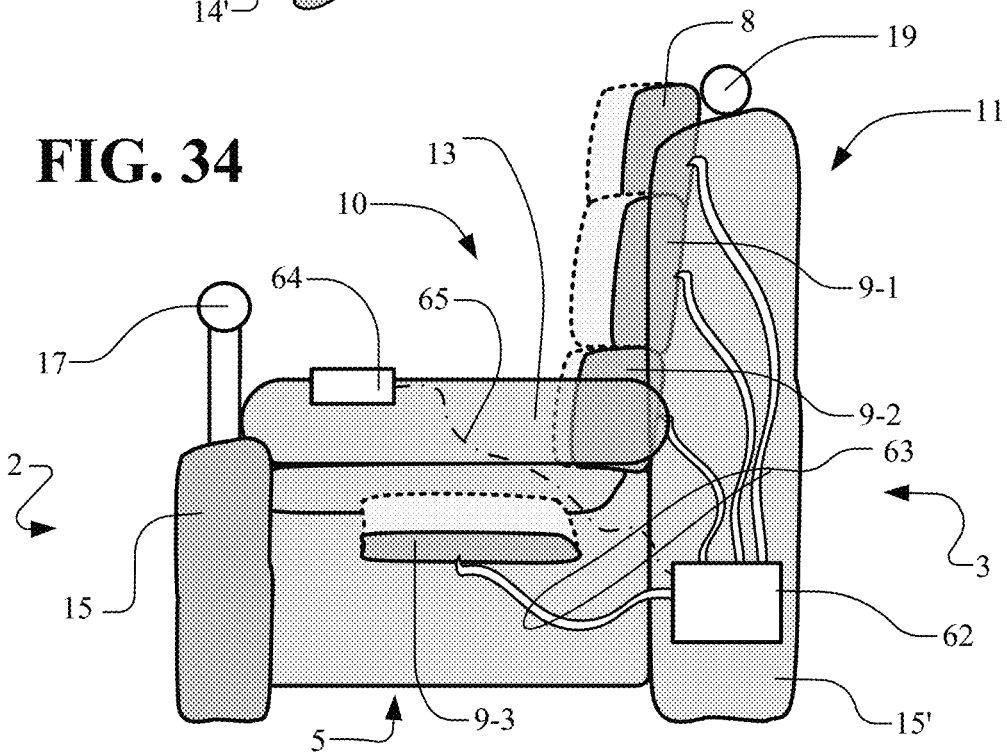
FIG. 34 depicts a side view of the easy chair of FIG. 32 revealing the pump and tubes for modifying the adjustable cushions.

In FIG. 34, a side view of the easy chair 10 of FIG. 32 is shown revealing the pump 62 and tubes 63 for modifying the inflation of the adjustable cushions 8, 9-1, 9-2 and 9-3. The easy chair 10 includes a front 2, a back 3, a first side 4 (not shown) and a second side 5. The arm 13 is along the side 5. The cushion 8 and the cushion 9-1 are part of the back component 11. The front leg 15 is in the front on the side 5. The back leg 15' is in the back on the side 5. A rigid support 17 is in the front on the side 5. A rigid support 19 is in the back nearer the side 5. While four adjustable pillows are shown, a larger or smaller number of adjustable pillows can be employed.

In FIG. 34, the control module 64 connects via electrical conductors 65, or via other connections such as pneumatic, to control the pump 62 to control the inflation levels of cushions 8, 9-1, 9-2 and 9-3. Adjustments in cushions 8, 9-1, 9-2 and 9-3 help to provide proper pelvic tilt, help to provide adjustable lumbar and/or neck and head support for alignment. While the inflation levels may have static values adjusted by each person to fit each person's body size and proportion in chair 10 for their own particular comfort and need, dynamic operation is also present in other modes of operation whereby the pressure settings of the cushions 8, 9-1, 9-2 and 9-3 are preset for different persons, are modified automatically over timed intervals by the control 64 to shift the body's position and help to avoid sedentary inducement and provide genuine comfort, improve circulation, avoid ulceration, and provide motion.

In one alternate embodiment, the pump 62 and the pump control 64 operate to add alternating pressures to one or more of the cushions 8, 9-1, 9-2 and 9-3. These alternating pressures occur in some embodiments at low frequencies changing over minutes and in other embodiments occur at higher frequencies changing over seconds. The effect on the body is to cause vibrations that simulate a massage of various intensities while helping to avoid sedentary inducement and provide genuine comfort, improve circulation and avoid ulceration.

Figure 35:
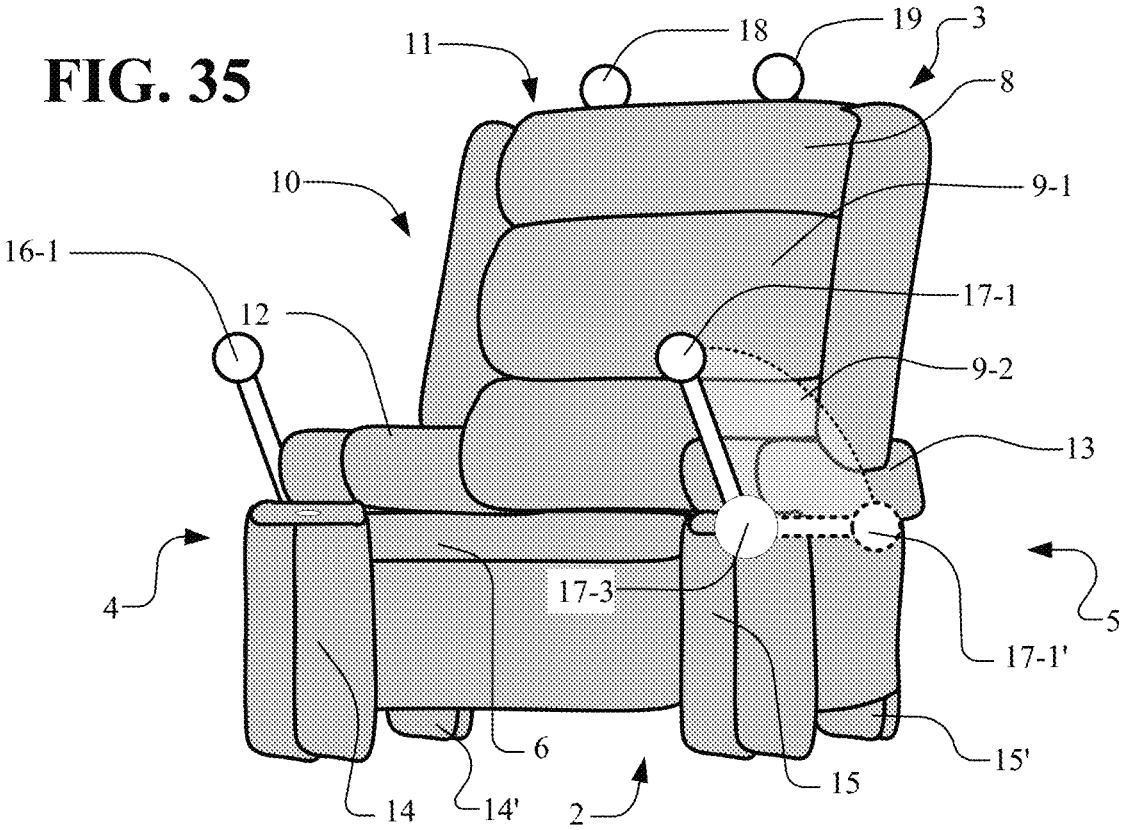
FIG. 35 depicts an easy chair having supports at the front of the chair extending above and in front of the arms.

In FIG. 35, a perspective view of easy chair 10 is shown having supports 16-1 and 17-1. The easy chair 10 includes a front 2, a first side 4 and a second side 5. A seat 6 extends from the front 2 to the back 3 between the side 4 and the side 5. The arm 12 is along the side 4 and the arm 13 is along the side 5. The cushions 8, 9-1 and 9-2 are part of the back component 11. The front leg 14 of the chair is in the front on the side 4 and the front leg 15 is in the front on the side 5. The back leg 14' is in the back on the side 4 and the back leg 15' is in the back on the side 5. A rigid support 18 is in the back and is nearer the side 4 and a rigid support 19 is in the back and is nearer the side 5. The supports 16-1 and 17-1 are movable to fixed positions parallel to the sides of arms 12 and 13, respectively. For example, support 17-1 is shown moved and latched at a position with the cap above arm 13 and in front of leg 15. The support 17-1 is held at a fixed position by the positional latch 17-3. After disengaging the latch 17-3, the support 17-1 is moved and latched at another fixed position shown by broken line phantom support 17-1'. The phantom support 17-1' is parallel to arm 13 and conveniently out of the way of being in front of the chair 10 and is used for exercise with an exercise band or otherwise by grasping the support 17-1' directly.

Figure 36:
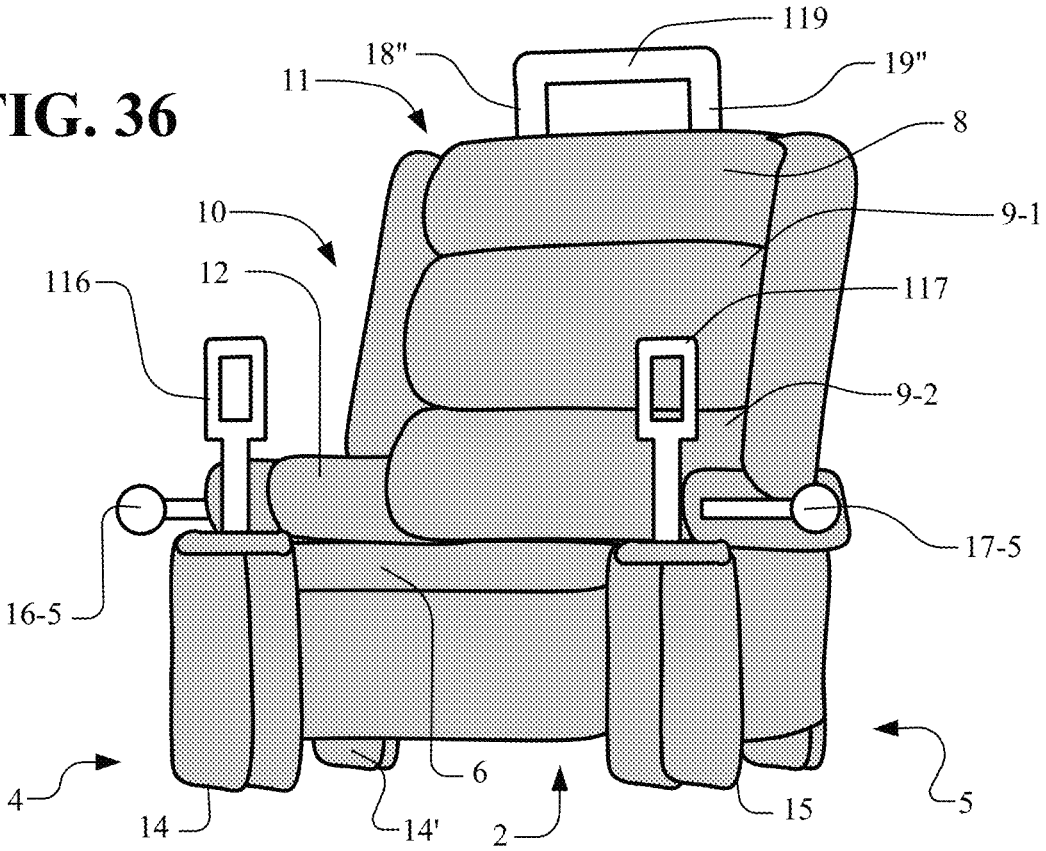
FIG. 36 depicts an easy chair having supports at the front of the chair extending out the sides of the arms.
Figure 37:
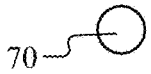
FIG. 37 depicts a top view of a spherical cap for a support.

In FIG. 36, an easy chair 10 is shown having supports 16-5 and 17-5 at the front of the chair extending out the sides of the arms. The easy chair 10 includes a front 2, a first side 4 and a second side 5. A seat 6 extends from the front 2 toward the back 3 between the side 4 and the side 5. The arm 12 is along the side 4 and the arm 13 is along the side 5. The cushions 8, 9-1 and 9-2 are part of the back component 11. The front leg 14 of the chair is in the front on the side 4 and the front leg 15 is in the front on the side 5. The back leg 14' is in the back on the side 4 and the back leg 15' is in the back on the side 5. A rigid support 116 is in the front on the side 4 and a rigid support 117 is in the front on the side 5. The supports 116 and 117 have open loops that are easy to grasp by the user of the chair. The supports 116 and 117 are representative of the many different shapes that can be employed for supports. Further representative shapes are shown in FIG. 37 though FIG. 44. A rigid support 18" is in the back nearer the side 4 and a rigid support 19" is in the back nearer the side 5. The supports 18" and 19" are connected by a horizontal member 119. The member 119 is typical of how many others of the supports optionally can be connected together. The supports 16-5 and 17-5 at the front of the chair extend horizontally out from the arm 12 and the arm 13, respectively, and are perpendicular to the sides of arm 12 and the arm 13. The support 16-5 and the support 17-5 are used for stabilizing a person during ingress or egress and are used for exercise with an exercise band or otherwise by grasping the supports directly.

In FIG. 37, a top view of a spherical cap 70 for a support is shown.

Figure 38:
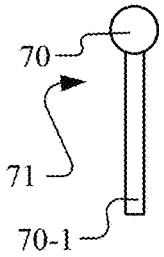
FIG. 38 depicts a support having the spherical cap of FIG. 37.

In FIG. 38, a front view is shown of a support 71 having the spherical cap 70 of FIG. 36 and having a rod 70-1 fixed to the cap 70.

Figure 39:
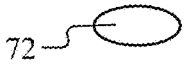
FIG. 39 depicts a top view of an oval cap for a support.

In FIG. 39, a top view of an oval cap 72 for a support is shown.

Figure 40:
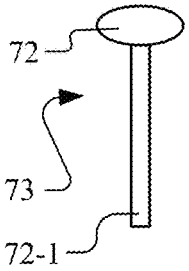
FIG. 40 depicts a support having the cap of FIG. 39.

In FIG. 40, a front view is shown of a support 73 having the cap 72 of FIG. 39 and having a rod 72-1 fixed to the cap 72.

Figure 41:
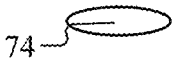
FIG. 41 depicts a top view of another oval cap for a support.

In FIG. 41, a top view of another oval cap 74 for a support is shown.

Figure 42:
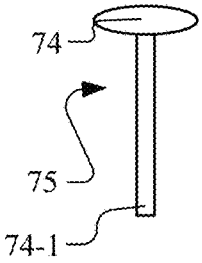
FIG. 42 depicts a support having the cap of FIG. 41.

In FIG. 42, a front view is shown of a support 75 having the cap 74 of FIG. 41 and having a rod 74-1 fixed to the cap 74.

Figure 43:
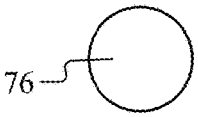
FIG. 43 depicts a top view of a circular cap for a support.

In FIG. 43, a top view of a circular cap 76 for a support is shown.

Figure 44:
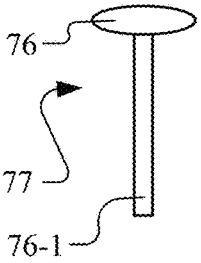
FIG. 44 depicts a support having the cap of FIG. 43.

In FIG. 44, a front view is shown of a support 77 having the cap 76 of FIG. 42 and having a rod 76-1 fixed to the cap 76.

In FIG. 37 through FIG. 44, the width dimensions of the caps are generally in the range from 1 inch to 5 inches and are selected in size to be comfortable for hand gripping, stabilization and exercise of a body. The dimensions of the rods are generally in the range from several inches in height to several feet in height and are selected in height depending on the location on and size of the chair or other apparatus on which they are used. Rods may be mechanically extended from inside the chair sides, armrests or other chair parts using hydraulic or motor mechanism or may be manually removed from fixed sleeves and stored in the arm rest compartment(s).

Figure 45:
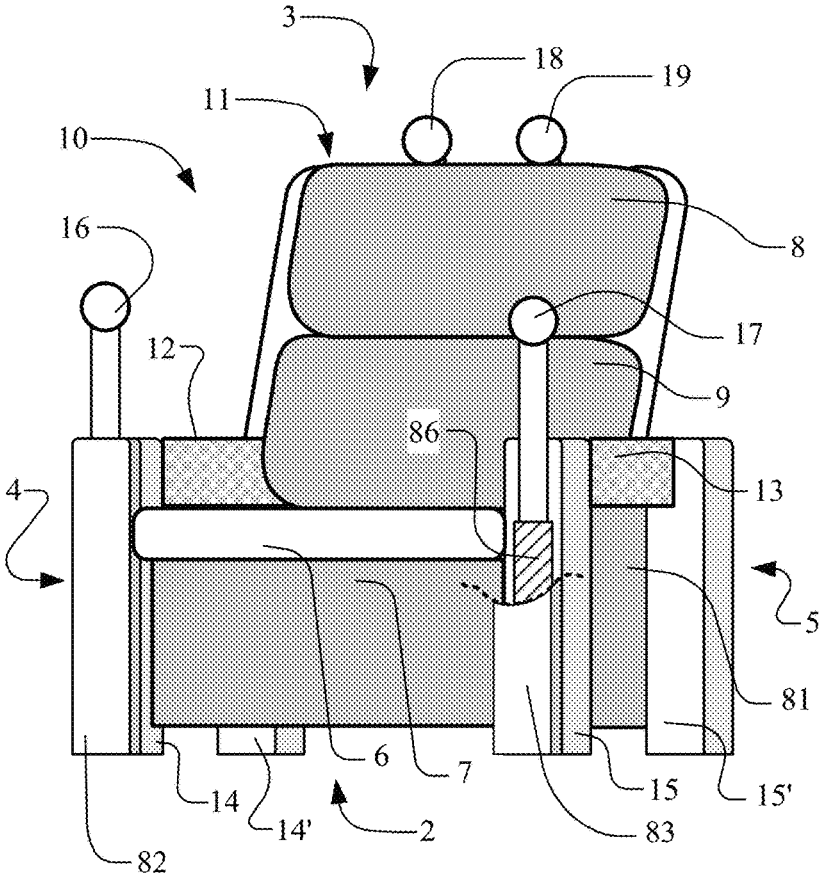
FIG. 45 depicts a perspective view of an easy chair having externally mounted supports.

In FIG. 45, a perspective view of an easy chair having externally mounted supports 16 and 17 is shown. The easy chair 10 includes a front 2, a back 3, a first chair side 4 and a second chair side 5. A seat 6 extends from the front 2 toward the back 3 between the side 4 and the side 5. The seat 6 is cushioned to provide easy chair comfort. A front panel 7 extends between the leg 14 and the leg 15 and below the cushion 6. A side panel 81 extends between the front chair leg 15 and the back chair leg 15'. The arm 12 is along the side 4 and the arm 13 is along the side 5. The cushions 8 and 9 are part of the back component 11. The front leg 14 of the chair is in the front on the side 4 and the front leg 15 is in the front on the side 5. The back leg 14' is in the back on the side 4 and the back leg 15' is in the back on the side 5. A rigid support 16 is in the front on the side 4 and a rigid support 17 is in the front on the side 5. A rigid support 18 is in the back nearer the side 4 and a rigid support 19 is in the back nearer the side 5. The support 16 and the support 17 are external to the chair 10 and are attached by support box 82 and support box 83, respectively, to the chair 10. The support box 82 and support box 83 are attached by bolts or other attaching means so as to be fixed relative to the chair 10.

Figure 46:
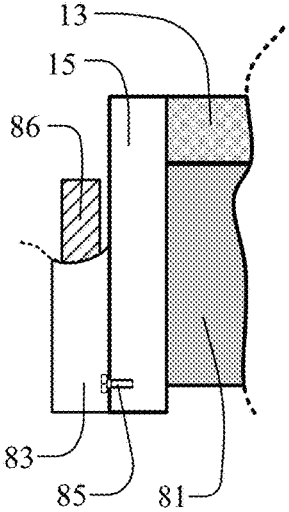
FIG. 46 depicts a side view of a portion of an externally mounted support of FIG. 45.

In FIG. 46, a side view of a portion of the easy chair 10 of FIG. 45 is shown. The support box 83 is attached by bolts, including bolt 85, bolted to the leg 15, so as to be fixed with respect to the chair 10. The internal tube 86 is rigidly attached to the box 83 and is fixed by epoxy, by a frictional fit or by other means. Alternatively, an automatically controllable support, of the type described in FIG. 2, can be used in FIG. 45 and FIG. 46 whereby the height of the support 17 is electrically controllable.

Figure 47:
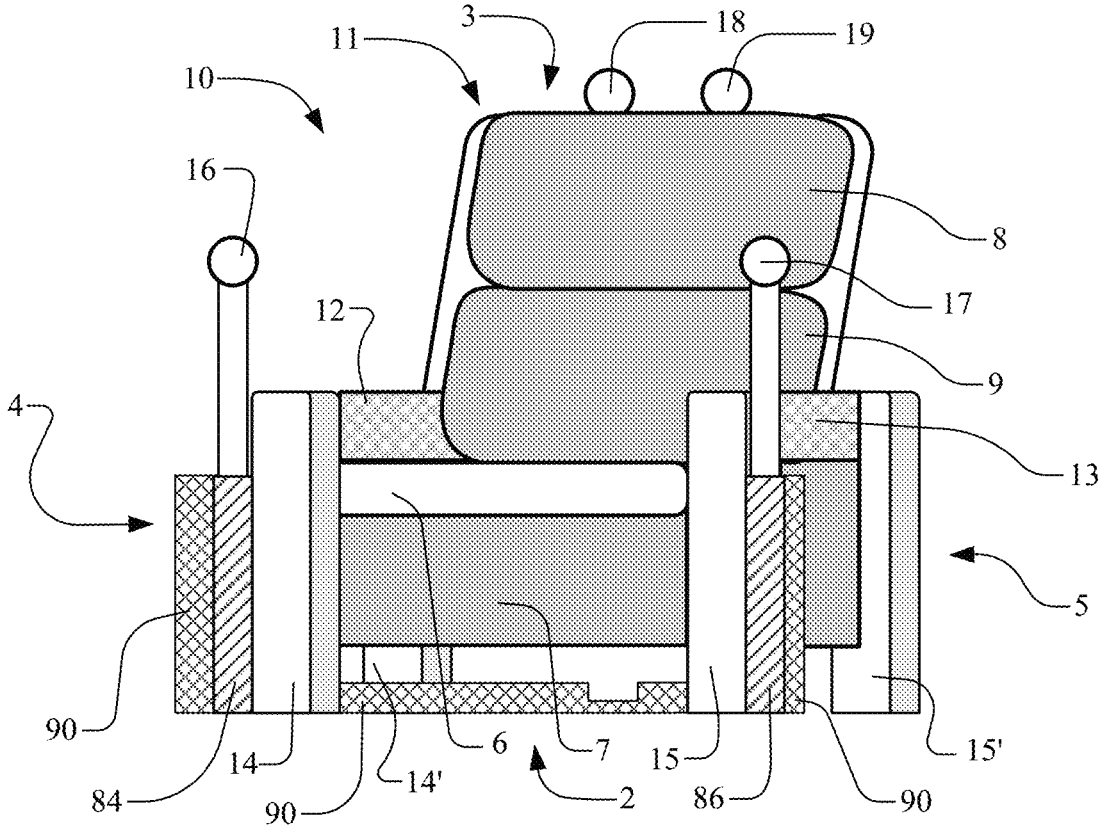
FIG. 47 depicts a perspective view of another easy chair having externally mounted supports on an external base.

In FIG. 47, a perspective view is shown of another easy chair 10 having externally mounted support 16 and support 17 on an external base 90. The easy chair 10 includes a chair front 2, a chair back 3, a first chair side 4 and a second chair side 5. A seat 6 extends from the front 2 toward the back 3 between the chair side 4 and the chair side 5. The seat 6 is cushioned to provide easy chair comfort. A front panel 7 extends between the leg 14 and the leg 15 and below the cushion 6. The arm 12 is along the side 4 and the arm 13 is along the side 5. The cushions 8 and 9 are part of the back component 11. The front leg 14 of the chair is in the front on the side 4 and the front leg 15 of the chair is in the front on the side 5. The back chair leg 14' is in the back on the side 4 and the back chair leg 15' is in the back on the side 5. A rigid support 16 is in the front on the side 4 and a rigid support 17 is in the front on the side 5. A rigid support 18 is in the back nearer the side 4 and a rigid support 19 is in the back nearer the side 5. The rigid base 90 engages against the leg 14 and the leg 15, or alternatively is under the legs of chair 10, so as to be held fixed with respect to the chair 10. The base 90 holds the tube 84 and holds the tube 86 so that that the support 16 and the support 17 are fixed with respect to the chair 10. Similarly, the support 18 and the support 19 are fixed with respect to the chair 10.

Figure 48:
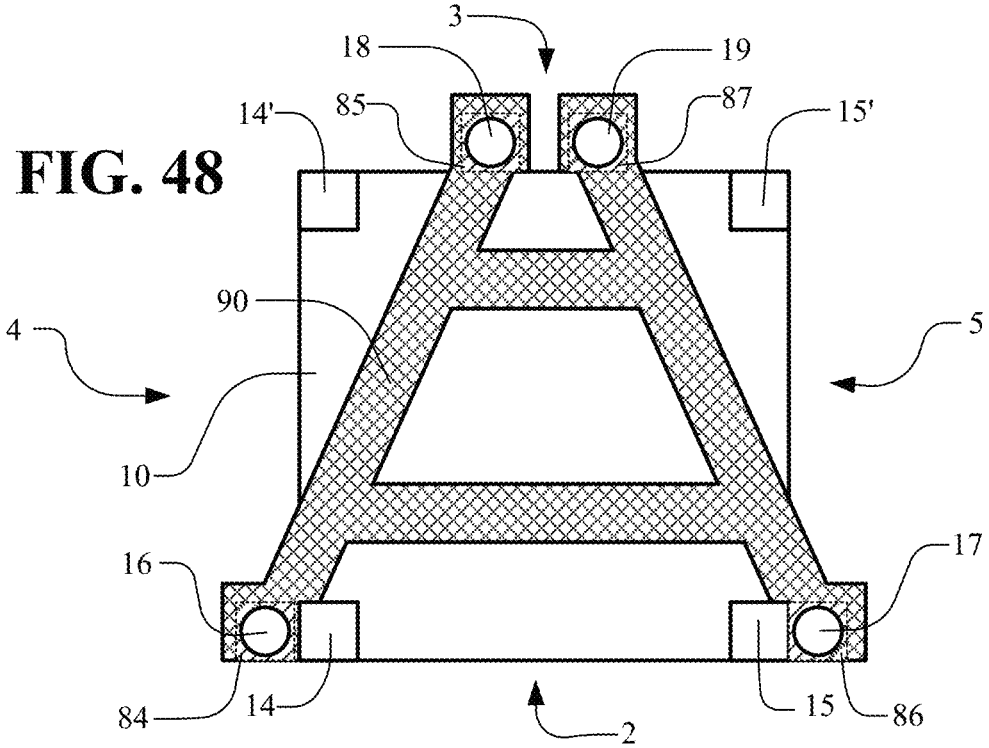
FIG. 48 depicts a bottom view of the easy chair and external base in FIG. 47.

In FIG. 48, a bottom view is shown of the easy chair 10 of FIG. 45 and includes an external base 90. The easy chair 10 includes a front 2, a back 3, a first side 4 and a second side 5. The chair 10 has leg 14, leg 14', leg 15 and leg 15'. The tube 84 and the tube 86 are near the front 2 and hold the support 16 and the support 17, respectively. The tube 85 and the tube 87 are near the back 3 and hold the support 18 and the support 19, respectively. The external base 90 is not part of the chair 10 so that chair 10 can be made, sold and used as a conventional easy chair without having any supports for exercising and stabilizing. However, the external base 90 is added to chair 10 to provide the exercising and stabilizing features previously described.

Figure 49:
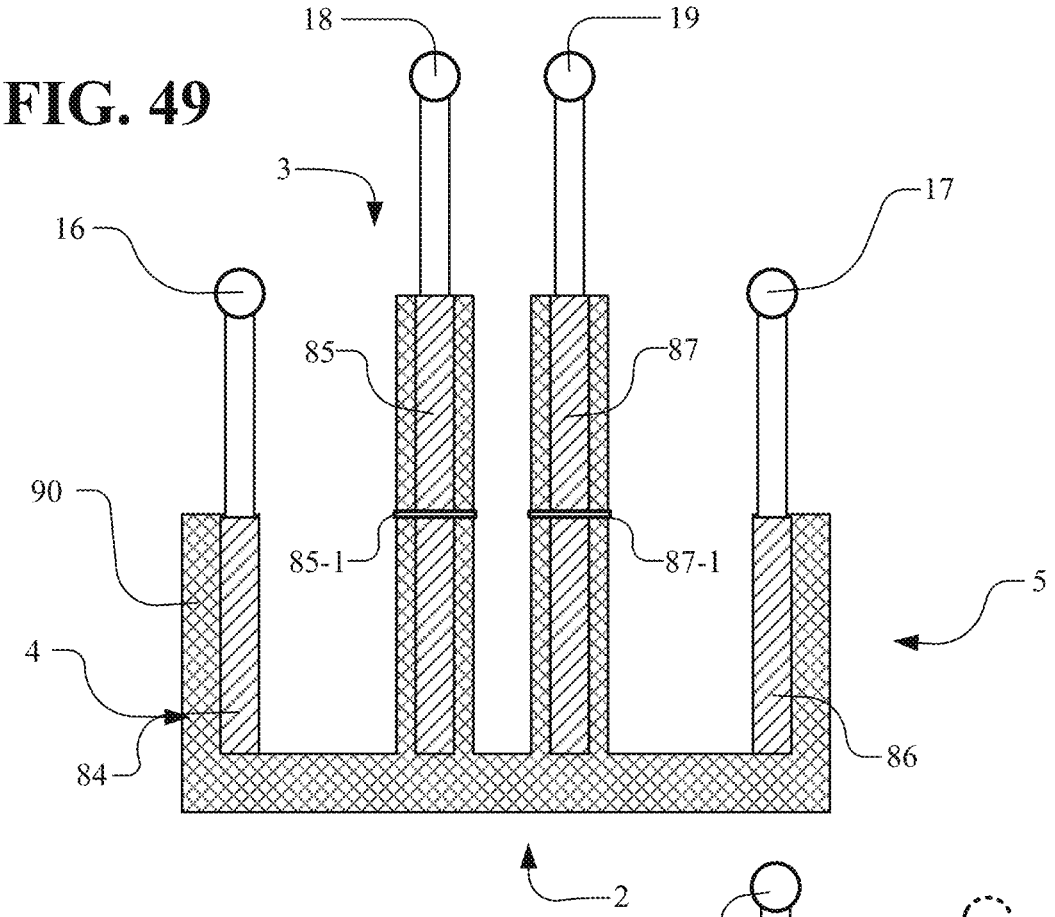
FIG. 49 depicts a front view of the external base in FIG. 47.

In FIG. 49, a front view is shown of the external base 90 used with the chair 10 in FIG. 47. The external base 90 includes a front 2, a back 3, a first side 4 and a second side 5. The tube 84, the tube 85, the tube 87 and the tube 86 are held by the base 90 to fix the support 16, the support 17, the support 18 and the support 19 relative to the chair 10 of FIG. 47. The external base 90 converts the ordinary easy chair 10 of FIG. 45 to a stabilizing and exercising chair. The base 90 includes a hinge 85-1 for the tube 85 and includes a hinge 87-1 for the tube 87. The hinge 85-1 and the hinge 87-1 permit the support 18 and the support 19, respectively, to bend when the base 90 is used with a reclining chair when the chair reclines.

Figure 50:
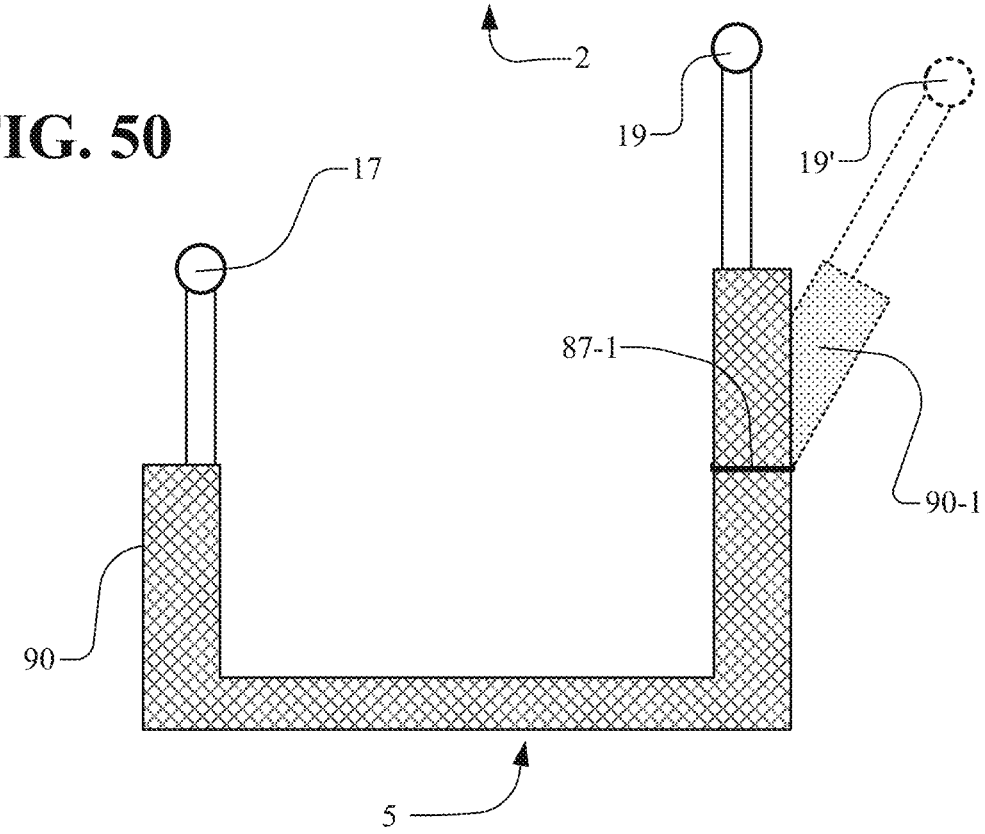
FIG. 50 depicts a side view of the external base in FIG. 49.

In FIG. 50, a side view is shown of the external base 90 of FIG. 49. The support 17 and the support 19 are held fixed by the base 90 relative to the chair 10 of FIG. 47. When the chair 10 relines, the hinge 87-1 rotates to allow support 19 to follow the recline of the chair 10. A rotated position of a portion of the base 90 is shown at the phantom position shown by base 90-1.

Figure 51:
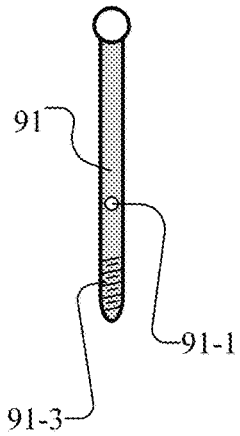
FIG. 51 depicts a side view of a support having a hole for use in manual height adjustment.

In FIG. 51, a side view is shown of a support 91 having a hole 91-1 for use in manual height adjustment. The support 91 optionally has a threaded end 91-3 for screwing into a base (see FIG. 53).

Figure 52:
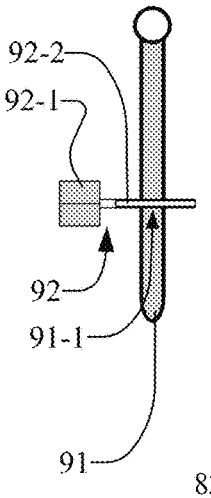
FIG. 52 depicts a front view of the support of FIG. 51 with a pin through the hole for use in manual height adjustment.

In FIG. 52, a front view is shown of the support 91 of FIG. 51 with a pin 92 through the hole 91-1 for use in manual height adjustment.

Figure 53:
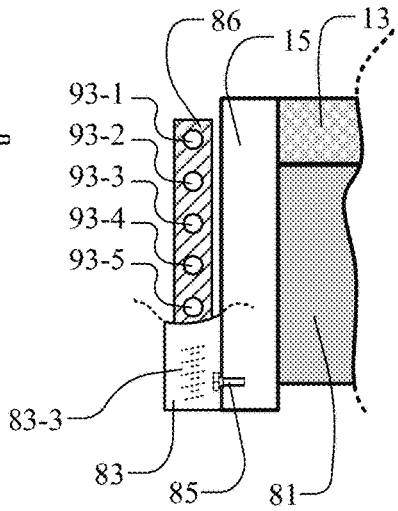
FIG. 53 depicts a side view of a portion of an externally mounted support of the FIG. 47 type.

In FIG. 53, a side view is shown of a portion of an externally mounted support box 83 of the FIG. 45 type. The support box 83 is attached by bolts, including bolt 85, bolted to the leg 15, so as to be fixed relative to the chair 10 of FIG. 45. The internal tube 86, for receiving and holding a support, is rigidly attached to the box 83 and is fixed by epoxy, by a frictional fit, by bolts or by other common means. The internal tube 86 has holes 93-1, 93-2, 93-3, 93-4 and 93-5 at vertical positions up the front of the chair portion of FIG. 53. The holes 93-1, 93-2, 93-3, 93-4 and 93-5 are positioned so a selected one of them is to receive the pin 92 of FIG. 52 to establish the height of the top of support 91 above the arm 13. In an alternate embodiment, the cylindrical tube 91 with threads 91-3 screws into the screw threads 83-3, adhered to the front of the chair, so that the support post 91 is rigidly attached and does not pop out or move when the user is standing and perhaps teetering when leaving the chair.

Figure 54:
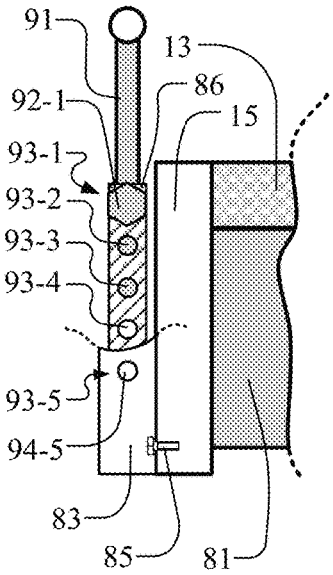
FIG. 54 depicts the side view of the FIG. 53 portion with the support of FIG. 52 and pin fixing the support to a preselected height.

In FIG. 54, the side view of the FIG. 53 portion of the chair 10 of FIG. 45 is shown with the support 91 and pin 92 of FIG. 52 engaged for fixing the support 91 to a preselected height. The support box 83 is attached by bolts, including bolt 85, bolted to the leg 15, so as to be fixed relative to the chair 10 of FIG. 45. The internal tube 86, for receiving and holding a support, is rigidly attached to the box 83 and is fixed by epoxy, by a frictional fit, by bolts or by other means. The internal tube 86 has holes 93-1, 93-2, 93-3, 93-4 and 93-5 at vertical positions up the front of the chair portion of FIG. 54. The hole 92-1 receives the pin having pin head 92-1 to establish the height of the support 91 above the arm 13. The box 83 has holes corresponding to the holes 93-1, 93-2, 93-3, 93-4 and 93-5 in internal tube 86 where hole 94-5 aligned with hole 93-5 is typical.

Figure 55:
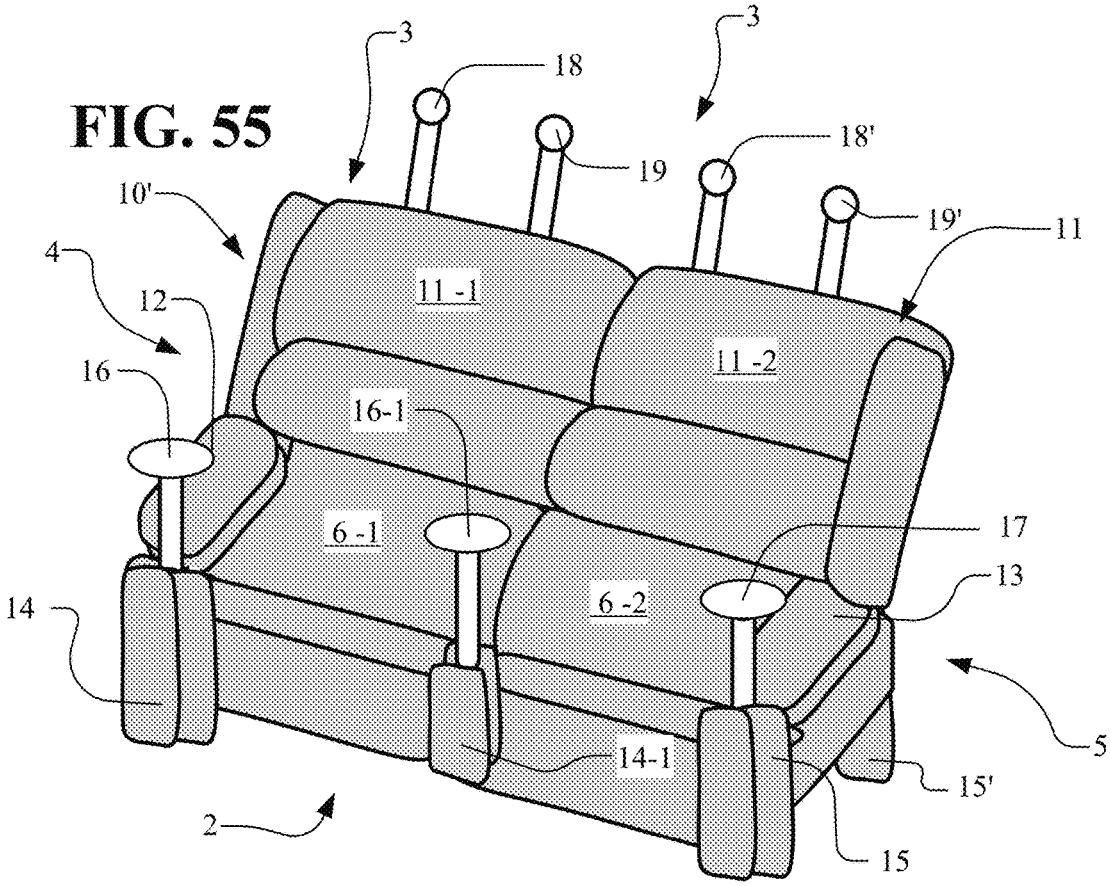
FIG. 55 depicts a perspective view of a love seat having supports.

In FIG. 55, a perspective view is shown of a love seat 10' having multiple supports including support 16, support 16-1, support 17, support 18, support 19, support 18' and support 19'. The love seat 10' includes a front 2, a back 3, a first side 4 and a second side 5. The chair 10 includes leg 14, leg 14-1, leg 15 and leg 15'. The love seat 10 is a seating apparatus for a first body (not shown) and a second body (not shown) including a front 2, a back 3, a first side 4 and a second side 5. The seating apparatus 10' includes a first seat 6-1 for the first body and a second seat 6-2 for the second body. The first seat 6-1 and the second seat 6-2 extend between the front 2 and the back 3 between the first side 4 and the second side 5. The seating apparatus includes a first back component 11-1 for the first body at the back 3 and includes a second back component 11-2 for the second body at the back 3. The seating apparatus includes legs, including leg 14, leg 14-1, leg 15 and leg 15'. The seating apparatus 10' is cushioned for providing comfortable seating for the first body and for the second body. The seating apparatus 10' includes a frame for the first seat 6-1, for the second seat 6-2, for the first back component 11-1, for the second back component 1-2 and for leg 14, leg 14-1, leg 15 and leg 15' and other legs (not shown), The frame for the seating apparatus 10' is substantially the same as two of the frames of the FIG. 2 type juxtaposed side by side. The frame for the back component 11-1 and the back component 11-2, in one embodiment, are connected together and operate as a single unit. In another embodiment, the frame for the back component 11-1 and the back component 11-2 are separately operable for each body. The seating apparatus 10' includes support 16, support 16-1, support 17, support 18, support 19, support 18' and support 19' fixed with respect to the frame and extending from the seating apparatus to provide stationary anchors for use by the first body and by the second body with the seating apparatus 10'. The exercises and stabilization previously described are available and provided for with the love seat 10'

Figure 56:
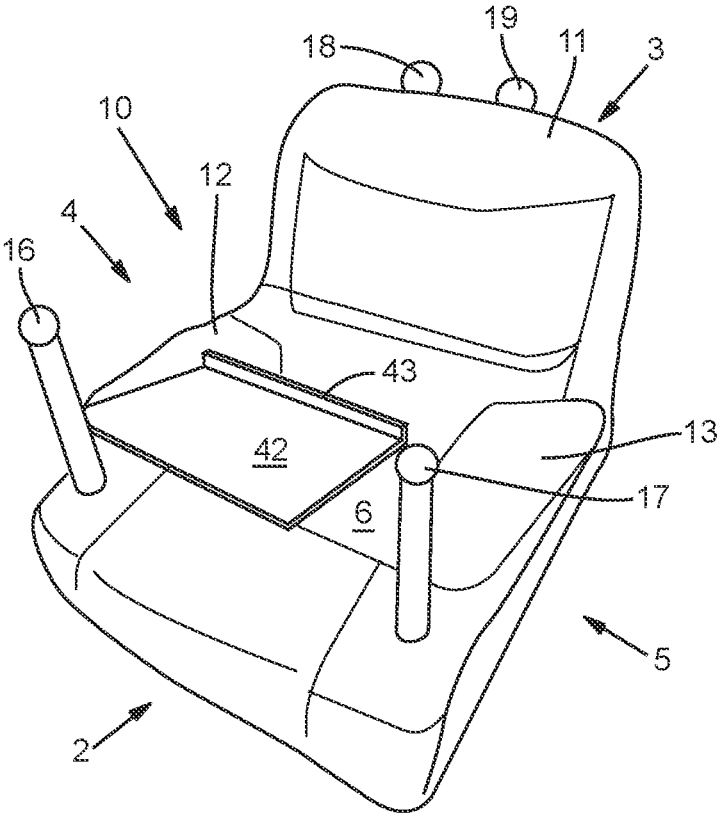
FIG. 56 depicts a perspective view of one finished embodiment of a chair with two supports in the front, two supports in the back and a work tray.

In FIG. 56, a perspective view is shown of one embodiment of a finished easy chair 10 with a support 16 and a support 17. The easy chair 10 includes a front 2, a back 3, a first side 4 and a second side 5. A cushioned seat 6 is located between the arm 12 and the arm 13 extending from front 2 toward the back 3. The arm 12 is along the side 4 and the arm 13 is along the side 5. A back component 11 is toward the back 3. A rigid support 16 is in the front on the side 4 and a rigid support 17 is in the front on the side 5. The support 16 and the support 17 are fixed relative to the easy chair 10 in the manner previously described in this specification. A rigid support 18 is in the back nearer the side 4 and a rigid support 19 is in the back nearer the side 5. The support 18 and the support 19 are fixed relative to the easy chair 10 in the manner previously described in this specification. The easy chair 10 includes a tray 42 with a back elevated edge 43 where the edge 43 operates to prevent books, computers, trays and other things on the tray 42 from falling off the back edge when tray 42 is tilted. The exercises and stabilization previously described are available with the finished chair 10 of FIG. 52.

The chair of FIG. 56 can be used at all times as a normal piece of furniture. The supports 16, 17, 18 and 19 can be ignored or removed. When the supports 16, 17, 18 and 19 are present and used, along with inflatable cushions as previously described, the chair 10 provides health benefits including comfort, exercise, posture, ingress, egress, support, fitness, stress reduction, stretching and alleviation or prevention of back and other body pain.

Figure 57:
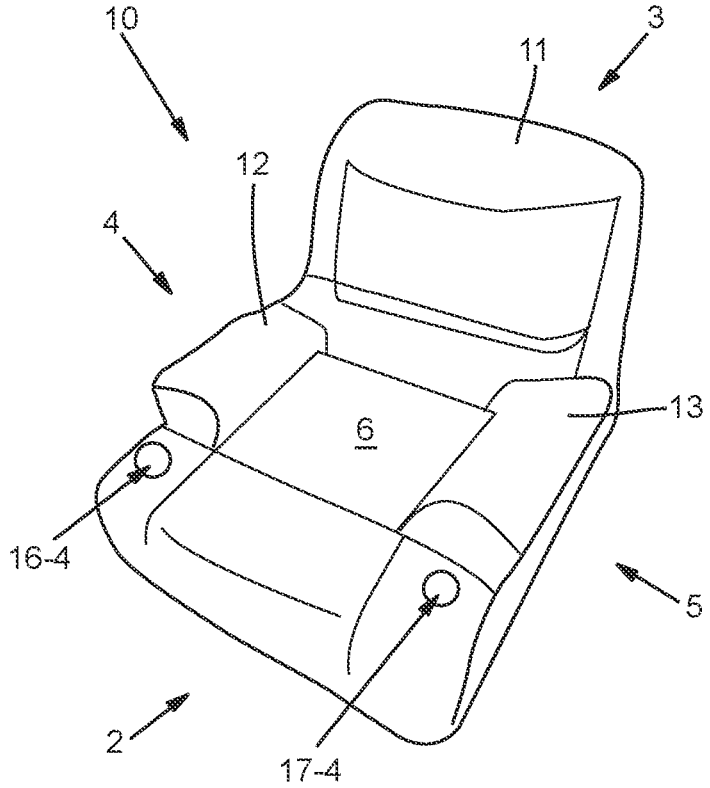
FIG. 57 depicts the chair of FIG. 56 with the two supports in the front, the two supports in the back and the work tray all hidden from view.

In FIG. 57, the chair of FIG. 56 is shown with the supports 16, 17, 18 and 19 and with the work tray 42 all removed or hidden from view. For example, the cover 16-4 and the cover 17-4 for the support 16 and the support 17, respectively, hide the openings for support 16 and the support 17 when support 16 and the support 17 are retracted or removed. As such the chair of FIG. 57 can be used at all times as a normal piece of furniture and also appears as a normal piece of furniture without any substantial evidence of the exercising components.

The following TABLE 1, TABLE 2, TABLE 3 and TABLE 4 list a sample of the exercises performed using the seating apparatus of the present specification. These exercises are by way of example and many additional exercises well known in the health industry can be performed.

TABLE 1

| Exercises When Sitting Upright |
|---|
| Shoulder shrug and roll |
| Knee extension (aka lower leg raise) |
| Biceps Curl |
| Triceps extension |
| Abdominal brace |
| Abdominal forward bend (straps around rear supports and held in hands at shoulder) |
| Lateral side raise |
| Seated chest fly |
| Seated upper back fly |
| Seated abdominal curl |
| Chair sit-up |
| Reverse chair sit-up |
| Serratus and lats pull-over |
| Lats cross pull (using opposite supports) |
| Crashing symbols (using rear supports) |
| Calf lift |
| Frisbee toss and turn (twisting/rotating upper body) |
| Hamstring curl (using lower leg support as resistance lever) |
| Kegel Exercise |

TABLE 2

| Stretching Exercises When Chair Is In Reclined Position |
|---|
| Knee to chest |
| Piriformis stretch (ankle over opposite knee and pushing leg to side) |
| Wig wag (legs pulled up and rolling side-to-side |
| Bridge |
| Crunches |
| Hamstring stretch |

TABLE 3

| Exercises When Chair Is Partially or Fully Reclined |
|---|
| Biceps Curl |
| Triceps extension |
| Hamstring leg lift |
| Pectoral fly |
| Pushups (using rear supports) |
| Shoulder and upper back pull (Main supports) |
| Lower back resistance (using main supports and chair mechanism) |
| Assisted sit-ups (using hands on main supports) |
| Stair climb (band around foot and held in hands) |
| Leg raise (for abs) |
| Rowing (band around supports) |
| Pullups using hands on rear supports |
| Supine press (much like pushups) |
| Neck nod (continuous band around forehead and rear supports) |
| Kegel Exercise |

TABLE 4

| Exercises When Standing Facing Front of Chair Holding Supports |
|---|
| Rear leg raise for gluteus and hamstrings |
| Vertical pushup |

While the invention has been particularly shown and described with reference to preferred embodiments thereof it will be understood by those skilled in the art that various changes in form and details may be made therein without departing from the scope of the invention.

The invention claimed is:

1. A seating apparatus having a front, a back and a first side and a second side and including a cushioned seat extending between the front and the back and between the first side and the second side, including a cushioned back component at the back, including a first arm and a second arm extending between the front and the back, each arm including a cushioned armrest, and the seating apparatus including legs for supporting the seating apparatus on a floor, the seating apparatus being a cushioned easy chair substantially fully covered with cushioning material and providing comfortable seating of a person, the seating apparatus being a recliner chair with an extendable front panel or footrest at the front to support legs of the person in a raised position, a frame for supporting the seat, the back component, the arms and the legs, one or more posts secured to the frame within one or more of the legs so as to extend upwardly from the front of the seating apparatus to provide stationary anchors for use by the person while sitting in the seating apparatus, to assist the person in exiting the seating apparatus by gripping the posts to help the person move from a seated to a standing position, each post comprising a telescoping structure including three cylindrical relatively slidable sleeve members, adjustable telescopically so as to be extendable upwardly, to a height so as to be available to be grasped by the person desiring egress from the seating apparatus, or retracted down into the frame and essentially hidden from view, and the seating apparatus being devoid of any structure below and in front of the cushioned seat when the seating apparatus is not reclined and with the front panel or foot rest not extended.

2. The seating apparatus of claim 1 wherein the one or more posts extend to a position above the arm and above the seat whereby the post or posts provide an anchor for resistance to be used by the person for exercise.

3. The seating apparatus of claim 1, wherein the one or more posts comprise a first post extending upward from the front at the first side, and a second post extending upward from the front at the second side, and further including two rear posts extendable up from left and right sides of the back, to provide anchors for resistance to be used by the person for exercise.

4. The seating apparatus of claim 1, including a retractable tray, retractable into the frame at one side of the chair, for supporting items to be used by the person.

5. The seating apparatus of claim 1, including one or more compartments in the arms for storing items useful for the person.

6. The seating apparatus of claim 1, wherein the telescoping posts are adjustable in height under motor-driven control.

7. The seating apparatus of claim 1, the seating apparatus being provided with cushions adjustable to fit the person to provide comfortable seating for the person, the person having a pelvic region, a lumbar region, a neck region and a head, and the cushions being adjustable to provide a pelvic tilt in the pelvic region, adjust support in the lumbar region, adjust support in the neck region and adjust support of the head.

8. The seating apparatus of claim 7, wherein the cushions are inflatable and wherein the seating apparatus further includes a pump connected to the cushions for adjusting the pressure in the cushions, and a control for controlling the pump to establish a desired pressure in the cushions.

* * * * *